US005716009A

United States Patent [19]

Ogihara et al.

[11] Patent Number: 5,716,009

[45] Date of Patent: Feb. 10, 1998

[54] FLUID INJECTION NOZZLE

[75] Inventors: Yoshimi Ogihara, Toyohashi; Yasuhide Tani, Nagoya, both of Japan

[73] Assignee: Nippondenso Co., Ltd., Kariya, Japan

[21] Appl. No.: 397,935

[22] Filed: Mar. 3, 1995

[30] Foreign Application Priority Data

Mar. 3, 1994 [JP] Japan ..... 6-033759
Sep. 22, 1994 [JP] Japan ..... 6-228321

[51] Int. Cl.[6] ..... F02M 61/00

[52] U.S. Cl. ..... 239/533.12; 239/596; 239/601

[58] Field of Search ..... 239/533.12, 596, 239/597, 600, 601, 585.3, 654; 251/331; 116/200, 230, 278; 267/140.1

[56] References Cited

U.S. PATENT DOCUMENTS 4,628,576 12/1986 Giachino et al. .
4,647,013 3/1987 Giachino et al. ..... 251/331
4,756,508 7/1988 Giachino et al. .
4,828,184 5/1989 Gardner et al. .
4,907,748 3/1990 Gardner et al. .
5,220,900 6/1993 Wakeman .

FOREIGN PATENT DOCUMENTS 503757 9/1992 European Pat. Off. .
61-104156 5/1986 Japan .
6-8628 2/1994 Japan .

*Primary Examiner*—Lee W. Young
*Assistant Examiner*—Pamela J. Lipka
*Attorney, Agent, or Firm*—Cushman, Darby & Cushman IP Group of Pillsbury, Madison & Sutro LLP

[57] ABSTRACT

A fluid injection nozzle having its components easily positioned and assembled. The fluid injection nozzle comprises: a first plate having a first slit-shaped hole for passing a fluid therethrough; and a second plate superposed on the downstream side of the first plate and having a second hole communicating with a portion of the first hole. A characterizing portion is formed in at least one of the first plate and the second plate at a portion other than the first hole or the second hole for discriminating the upstream and downstream sides.

13 Claims, 31 Drawing Sheets

FLUID INJECTION NOZZLE

CROSS-REFERENCE TO RELATED APPLICATIONS

This application is based upon and claims priority from Japanese Patent Application No. 6-33759 filed Mar. 3, 1994 and Japanese Patent Application No. 6-228321 filed Sep. 22, 1994, with the contents of each document being incorporated herein by reference.

BACKGROUND OF THE INVENTION

1. Field of the Invention

The present invention relates to a fluid injection nozzle and, more particularly, to an injection nozzle portion of an electromagnetic fuel injection valve for injecting a fuel into an internal combustion engine for an automobile.

2. Description of the Related Art

Generally speaking, in the fluid injection nozzle to be used in the internal combustion engine, a valve member is slidably fitted in a guide hole formed axially in a valve body so that an injection port formed in the leading end portion of the valve body is opened and closed as the valve member moves up and down. As a result, the valve member has its valve opening lift accurately controlled to retain a proper injection rate of the fuel.

In the prior art, the fluid injection nozzle, as disclosed in Japanese Patent Application Laid-Open No. 61-104156, is equipped in front of its injection port with a number of slit-shaped orifices for passing the fuel from the injection port therethrough to atomize it over a wide angle.

In Japanese Patent Application Laid-Open No. 2-75757, on the other hand, the fluid injection nozzle is equipped with a plurality of silicone plates in front of the injection port. Thanks to these silicone plates, the fuel flow is controlled by forming a precise fuel passage pattern with the silicone plates.

Moreover, U.S. Pat. No. 4,647,013 discloses a fluid injection nozzle which is equipped in front of the injection port with a silicone flat plate having an orifice for controlling the fuel flow.

A variety of injection port shapes have been proposed in the prior art so as to promote the fuel atomization, as disclosed in the aforementioned Japanese Patent Application Laid-Open No. 61-104156.

Despite of these disclosures, however, a sufficient atomization cannot be attained by the injection port shapes of the prior art.

SUMMARY OF THE INVENTION

In view of the above-specified problems of the prior art, the present invention has an object to provide a fluid injection nozzle capable of atomizing a fluid.

Another object of the present invention is to provide a fluid injection unit capable of easily mounting a fluid injection nozzle having a metering function in the exit portion of the injection port of a fuel injection valve.

Still another object of the present invention is to provide a fluid injection nozzle capable of easily preventing an erroneous assembly of a plurality of components of the fluid injection nozzle.

In order to achieve the above-specified objects, according to a first preferred mode of the present invention, there is provided a fluid injection nozzle including a plurality of orifice plates having a first plate having a first slit-shaped hole for passing a fluid therethrough, a second plate superposed on the downstream side of the first plate and having a second hole communicating with a portion of the first hole, and a characterizing portion formed in at least one of the first plate and the second plate at a portion other than the first hole or the second hole for discriminating the upstream and downstream sides.

In one preferred mode of the present invention, the characterizing portion has different shapes, sizes or colors between the first plate and the second plate.

In another preferred mode of the present invention, the characterizing portion includes fitting portions formed in the first plate and the second plate for fitting each other.

According to the construction of the present invention as specified above, the fluid is not injected before it is passed through the first hole and then the second hole. Of these, the first hole is formed into the slit shape partially having communication with the second hole so that the first hole has a generally grooved shape excepting its communicating portion. As a result, the fluid flows along the slit-shaped first hole toward the second hole. Moreover, this flow along the slit-shaped first hole changes its direction, when it enters the second hole, to promote the atomization of the fluid to be injected.

In the fluid injection nozzle according to one preferred mode of the present invention, the characterizing portion for discriminating the upstream and downstream is formed in either the first plate or the second plate, so that these two plates can be easily discriminated when assembled. Thus, it is possible to drastically reduce the fear that the first and second plates are confused when assembled. At this assembling time, for example, one of the first and second plates can be prevented, when selected, from being confused with the other.

In another preferred mode, the first and second plates are different from each other in their shapes, sizes or colors so that one of them can be easily selected and prevented from being erroneously assembled. And further, in preferred mode, the side discriminating portion capable of discriminating the front and back of the plate is formed in the first and/or second plates so that the front and back of the one or two plates can be clearly discriminated.

DETAILED DESCRIPTION OF THE PRESENTLY PREFERRED EXEMPLARY EMBODIMENTS

The present invention will be described in the following in connection with its embodiments with reference to the accompanying drawings.

First Embodiment

In FIGS. 1 to 5, there is shown the first embodiment in which the present invention is applied to a fuel injection valve of a fuel feed system of a gasoline engine.

Figure 2:
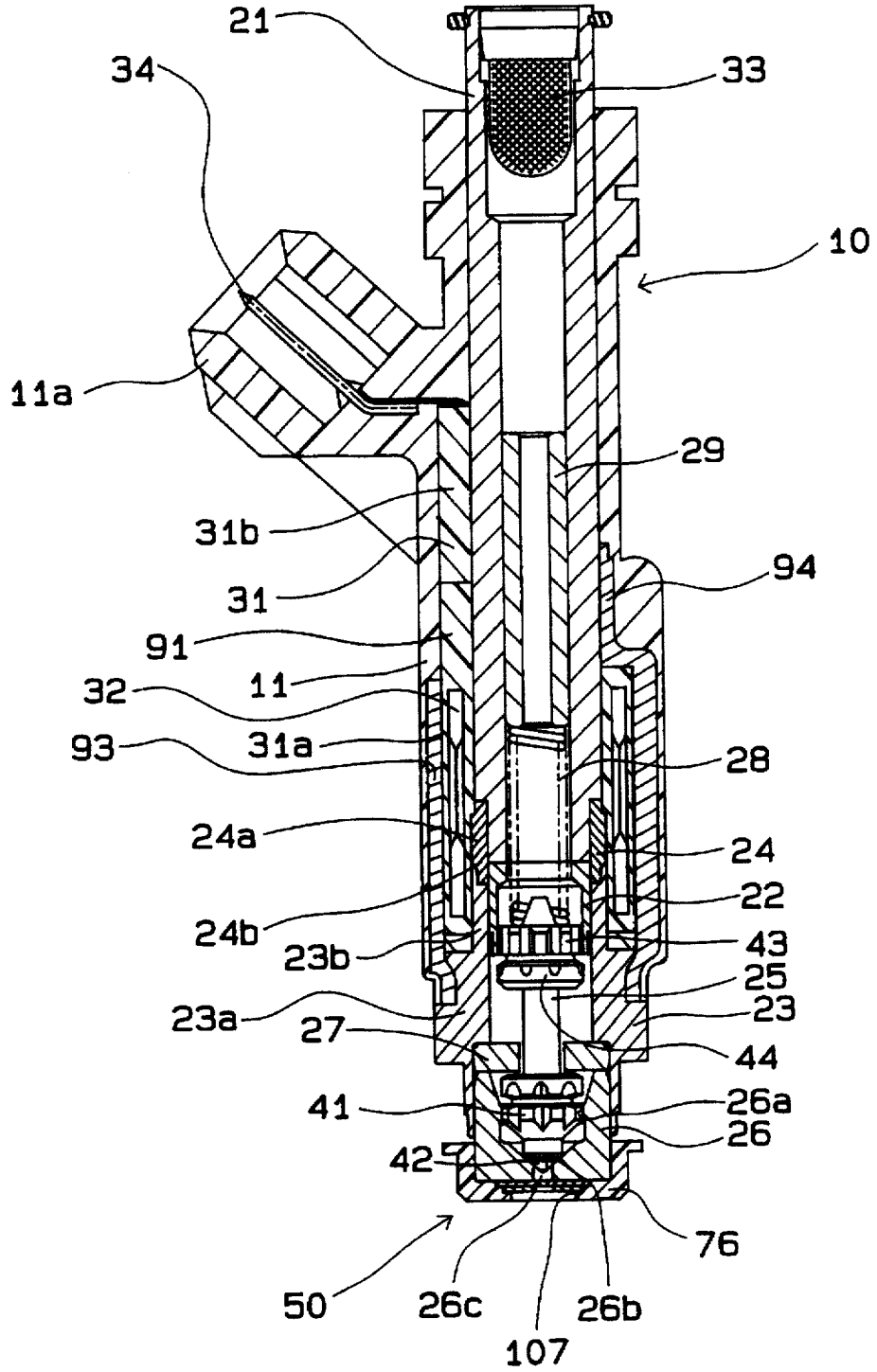
FIG. 2 is a section of the first embodiment, in which a fluid injection nozzle of the present invention is applied to a fuel injection valve.

In a mold housing 11 of a fuel injection valve 10 acting as a fluid injection nozzle, as shown in FIG. 2, there are integrally molded a stationary iron core 21, a spool 91, an electromagnetic coil 32, a coil mold 31, and metal plates 93 and 94 for establishing a magnetic path.

The stationary iron core 21 is made of a ferromagnetic material and is so disposed in the housing 11 as to protrude above the coil mold 31. A guide tube 29 is fixed on the inner wall of the stationary iron core 21.

The electromagnetic coil 32 is wound on the outer circumference of the spool 91 made of a resin, and the coil mold 31 is formed of a resin around the spool 91 and the electromagnetic coil 32 so that the electromagnetic coil 32 is enveloped by the coil mold 31. The coil mold 31 is composed of: a cylindrical portion 31*a* for protecting the electromagnetic coil 32; and a protrusion 31*b* protruding upward from the cylindrical portion 31*a* for projecting not only the lead wires led electrically from the electromagnetic coil 32 but also a later-described terminal 34. Moreover, the spool 91 and the electromagnetic coil 32 are mounted around the stationary iron core 21 such that they are integrated by the coil mold 31.

The two metal plates 93 and 94 are disposed to have their upper ends contacting with the outer circumference of the stationary iron core 21 and their lower other ends contacting with the outer circumference of a magnetic pipe 23 thereby to establish a magnetic path to passing a magnetic flux therethrough when the electromagnetic coil 32 is energized, and to cover the outer circumference of the cylindrical portion 31*a* while clamping the cylindrical portion 31*a* from the two sides. Thus, the electromagnetic coil 32 is protected by the two sheets of those metal plates 93 and 94.

Above the housing 11, there protrudes a connector portion 11*a* from the outer wall of the housing 11. In this connector portion 11*a* and the coil mold 31, there is buried the terminal 34 to be electrically connected with the electromagnetic coil 32. The terminal 34 is further connected with a not-shown electronic control unit through a wire harness.

A compression coil spring 28 has its one end abutting against the upper end face of a needle 25, which is fixedly welded on a movable iron core 22, and its other end abutting against the bottom portion of the guide tube 29. The compression coil spring 28 urges the movable iron core 22 and the needle 25 downward of FIG. 2, to seat a seat portion 42 of the needle 25 on a valve seat 26b of a valve body 26. When the exciting current is fed from the terminal 34 to the electromagnetic coil 32 through the lead wire by the not-shown electronic control unit, the needle 25 and the movable iron core 22 are attracted toward the stationary iron core 21 against the urging force of the compression coil spring 28.

A non-magnetic pipe 24 is connected to the lower portion of the stationary iron core 21 and is formed into a stepped pipe shape having a larger-diameter portion 24a and a smaller-diameter portion 24b. Of these, moreover, the larger-diameter portion 24a is so connected to the lower portion of the stationary iron core 21 as to partially protrude from the lower end of the stationary iron core 21. To the lower end of the smaller-diameter portion 24b of the non-magnetic pipe 24, furthermore, there is connected a smaller-diameter portion 23b of the magnetic pipe 23, which is made of a magnetic material and formed into a stepped pipe shape. Incidentally, the smaller-diameter portion 24b of the non-magnetic pipe 24 has its internal diameter set to a slightly smaller value than that of the smaller-diameter portion 23b of the magnetic pipe 23 to provide a guide portion for the movable iron core 22.

In the internal space of the non-magnetic pipe 24 and the magnetic pipe 23, there is fitted the movable iron core 22 which is made of a magnetic material and formed into a cylindrical shape. This movable iron core 22 has its external diameter set to a slightly smaller value than the internal diameter of the smaller-diameter portion 24b of the non-magnetic pipe 24 so that it is slidably supported by the non-magnetic pipe 24. Moreover, the movable iron core 22 has its upper end face opposed at a predetermined gap to the lower end face of the stationary iron core 21.

The needle 25 is formed at its upper portion with a flanged joint portion 43. This joint portion 43 is laser-welded to the movable iron core 22 to connect the needle 25 and the movable iron core 22 integrally. The needle 25 is further formed with a flange 44 below and near the joint portion 43. This joint portion 43 is formed in its outer circumference with a plurality of grooves acting as fuel passages.

Above the stationary iron core 21, there is disposed a filter 33 for filtering out foreign matters such as dust in the fuel which is pumped by a fuel pump or the like from the fuel tank into the fuel injection valve 10.

The fuel having flown into the stationary iron core 21 through the filter 33 will pass from the guide tube 29 through the gap in the knurled grooves formed in the joint portion 43 of the needle 25 and further through the knurled grooves formed in both the cylindrical face 26a of the valve body 26 and in the guide portion 41 of the needle 25 and will reach the valve portion which is composed of the seat portion 42 at the leading end of the needle 25 and the valve seat 26b, until it will flow from the valve portion into an injection port 26c. As partially shown in detail in an enlarged scale in FIG. 1, the fuel is then injected from a through hole 107 of a sleeve 76 via a first orifice 78 of a first orifice plate 70 and a second orifice 80 of a second orifice plate 74.

Here will be described the construction of an injection unit 50 of the fuel injection valve 10 with reference to FIG. 1.

The valve body 26 is inserted and laser-welded through a hollow disc-shaped spacer 27 in a larger-diameter portion of the magnetic pipe 23. The spacer 27 has its thickness adjusted to hold the air gap between the stationary iron core 21 and the movable iron core 22 at a predetermined value. The valve body 26 is formed on its inner wall with the cylindrical face 26a, on which is slid the guide portion 41 of the needle 25, and the valve seat 26b on which is seated the cylindrical seat portion 42 of the needle 25. The valve body 26 is further formed with the injection port 26c at the center of its bottom portion.

The needle 25 is formed with such a flange 36 as is opposed at a predetermined gap to the lower end face of the spacer 27 fitted in the inner wall of the larger-diameter portion 23a of the magnetic pipe 23. This flange 36 is formed on that side of the full length of the needle 25, which is located at the seat portion 42 formed at the leading end of the needle 25. Below the flange 36, there is formed the guide portion 41 which is made slidable in the cylindrical face 26a formed on the valve body 26. Incidentally, the joint portion 43 and the guide portion 41 formed in the needle 25 have their outer circumferences knurled by the rolling method.

On the bottom portion of the outer circumferential wall of the valve body 26, moreover, there is fitted the bottomed cylindrical sleeve 76 which is made of a synthetic resin. This sleeve 76 is formed at its center with a first fitting hole 76a and a second fitting hole 76b and further with the through hole 107 continued from the second fitting hole 76b.

On the front side of the injection port 26c of the valve body 26, there is placed the first orifice plate 70, on the lower face of which is laid in close contact the second orifice plate 74. These first and second orifice plates 70 and 74 are fixed liquid-tight on the end face 26d of the valve body 26, and the sleeve 76 is press-fixed for the protecting purpose on the valve body 26.

Figure 3:
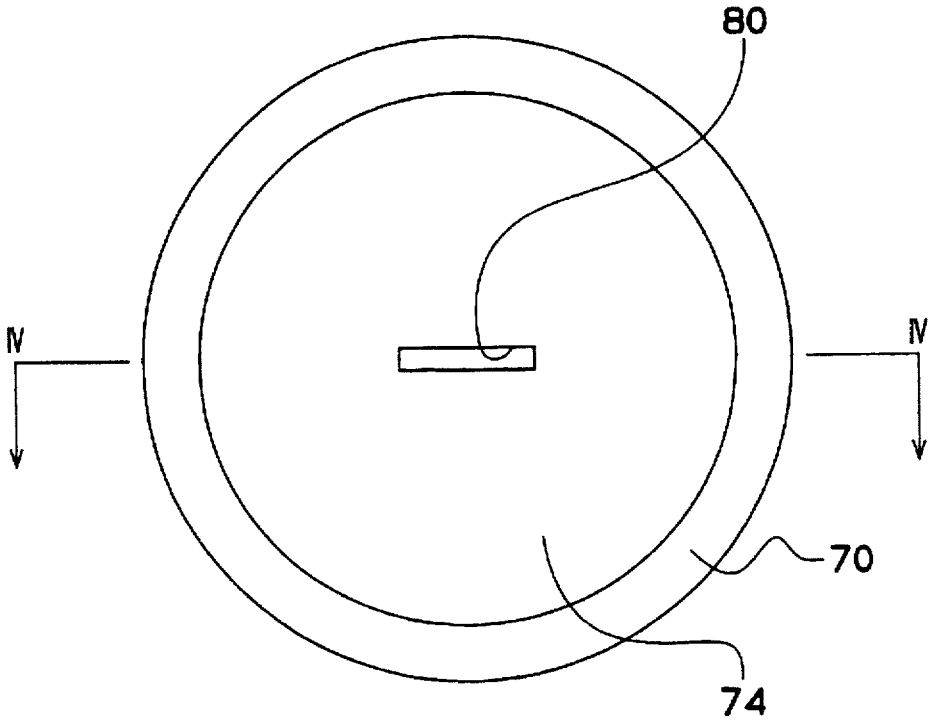
FIG. 3 is a bottom view of the fluid injection nozzle of the first embodiment of the present invention.
Figure 4:
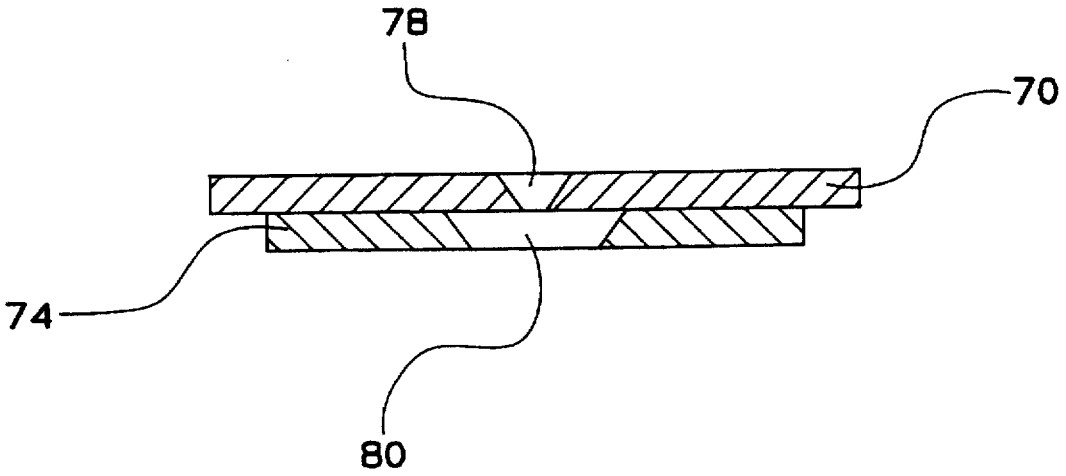
FIG. 4 is a section taken along line IV—IV of FIG. 3.

The first orifice plate 70 is formed of a metal into a circular contour, as shown in FIGS. 3 and 4, which is formed at its central portion with the first orifice 78 providing a slit-shaped hole. This metal should not have its kind limited, if it has a corrosion-resistance to the fuel, but is suitably exemplified by SUS 304 from the point of its moldability and light weight. The first orifice 78 is given such a thin, straight through hole as is converged downward of FIG. 1 (i.e., downstream of the fuel flow).

The second orifice 74 is also made of a metal, as suitably exemplified by SUS 304 which is stainless steel defined in Japanese Industrial Standard like the first orifice plate 70, but is formed into a similar shape but having a smaller diameter than that of the first orifice plate 70. The second orifice plate 74 is formed with the second orifice 80 or the slit-shaped hole which is arranged at a right angle with respect to the first orifice 78. Like this first orifice 80, the second orifice 80 is converged downward. When fitted in the valve body 26, moreover, the first and second orifice plates 70 and 74 are superposed such that the first and second orifices 78 and 80 are perpendicular to each other.

At the assembling time, the first and second orifice plates 70 and 74 are so laser-welded in the superposed state to the valve body 26 as to have their first and second orifices 78 and 80 at a right angle, and the sleeve 76 is press-fixed on the valve body 26.

Figure 1:
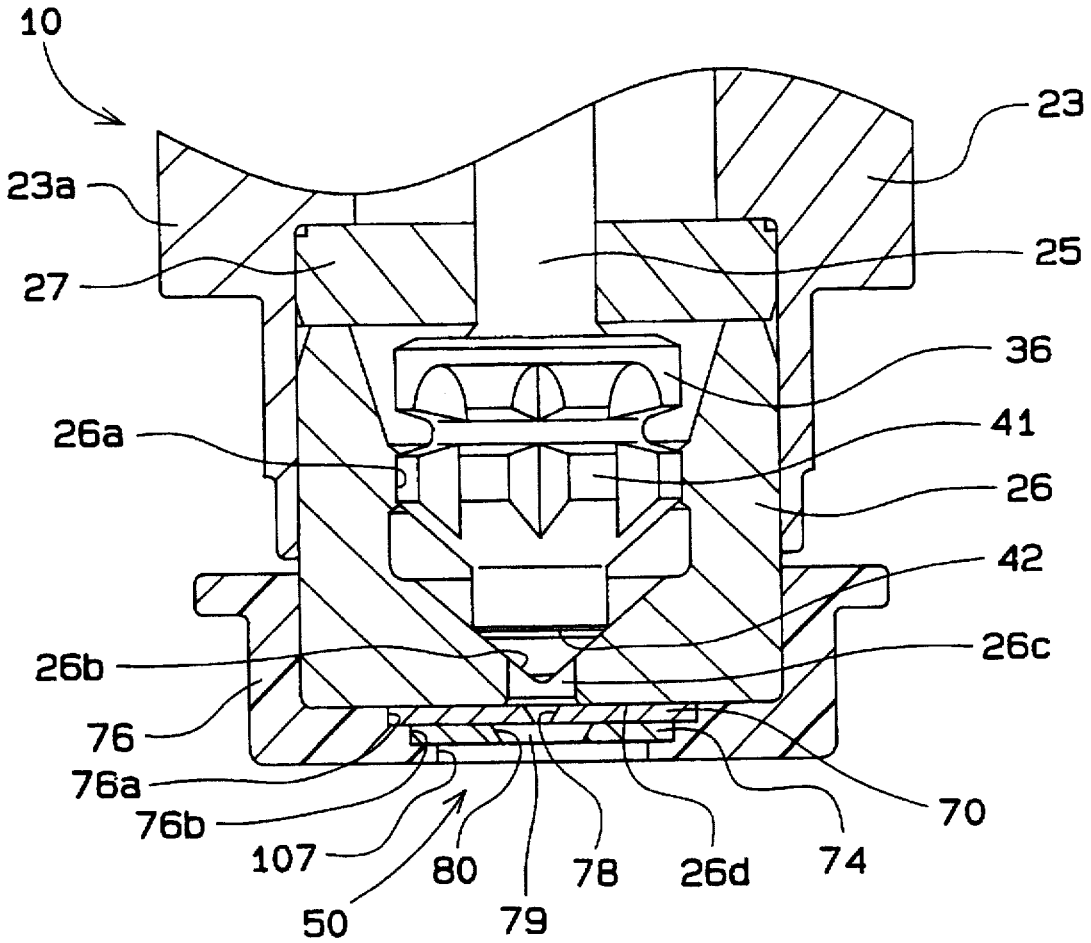
FIG. 1 is an enlarged section of an essential portion of the first embodiment of the present invention.
Figure 5:
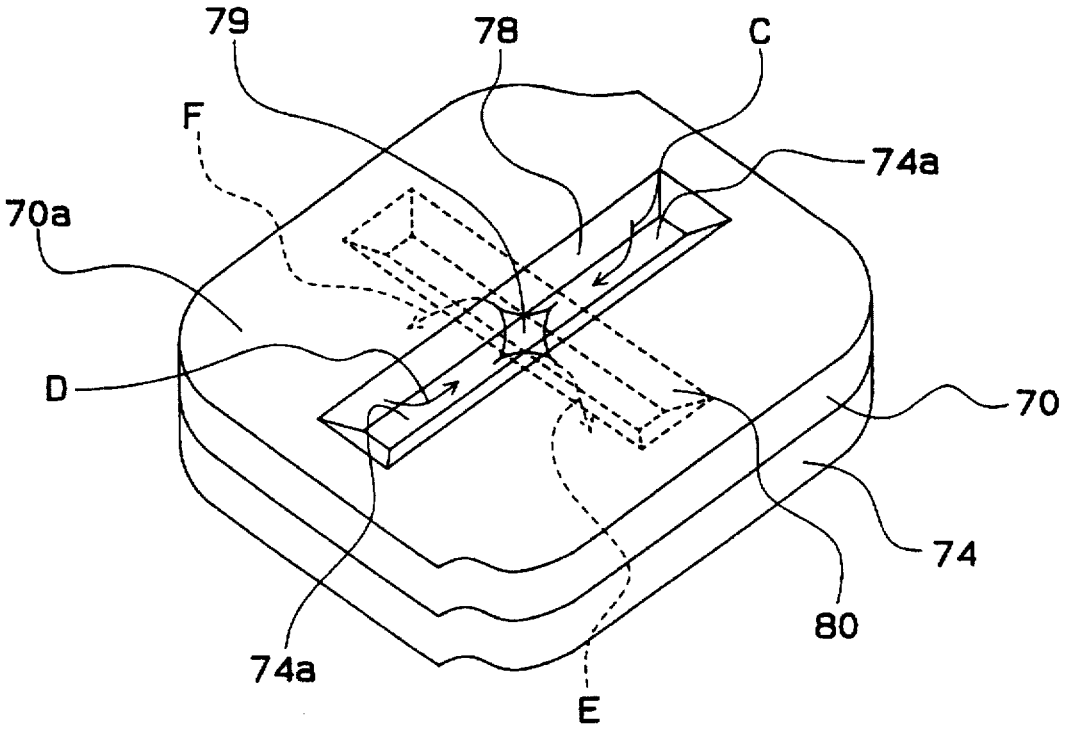
FIG. 5 is a perspective view for explaining the fuel flow directions of the fluid injection nozzle of the first embodiment of the present invention.

When the needle 25 is lifted from the valve seat 26b of the valve body 26, as shown in FIG. 1, the fuel is injected from the injection port 26c. The fuel thus injected from the injection port 26c is then injected downward through a through hole 79 at the intersection portion between the first orifice 78 and the second orifice 80. At this time, as shown in FIG. 5, the fuel to pass through the first orifice 78 partially impinges upon the upper face 74a of the second orifice plate 74, as indicated by solid arrows C and D in FIG. 5, so that it flows toward the through hole 79 via the approach ways which are defined by that upper face 74a and the wall faces of the first orifice 78. The flows C and D coming from the two side approach ways impinge upon each other over the through hole 79 to change their directions, and pass through the second orifice 80 in the longitudinal direction while being diverged in a sector shape, as indicated by broken arrows E and F. Here, the fuel having flown through the through hole 79, which is overlapped by the first and second orifices 78 and 80, has its divergence of atomization regulated by the two longitudinally extending walls of the four walls defining the second orifice 80. Thus, the atomization is promoted by the mutual impingement of the fuel flows having passed through the first orifice 78 as the approach way to diverge along the atomization guide passage formed by the second orifice 80, and by the further impingement of the fuel flows having passed over the converging opposed taper faces formed on the second orifice 80. According to this embodiment, moreover, the groove-shaped approach ways are defined by the first orifice 78 and the upper face of the second orifice 74 so that the fine atomization can be achieved with the simple construction which is made by forming the slit-shaped orifices in the two plates.

According to this first embodiment, the fuel injected from the injection port 26*c* is injected through the first orifice 78 and the second orifice 80 from the through hole 107. The fuel thus injected passes through the converging first orifice 78 and then through the converging second orifice 80 so that it is atomized with excellent characteristics having a narrow angle of injection. As a result, the fuel to be fed from the not-shown intake port to the combustion chamber of an internal combustion engine is so atomized as to be easily burned out.

According to this first embodiment, moreover, the first orifice plate 70 and the second orifice plate 74 are given such different shapes or sizes that they can be easily discriminated from each other when they are to be assembled. This drastically reduces a fear that the first and second orifice plates 70 and 74 might otherwise be erroneously assembled. At the assembling time, for example, the first or second orifice plate 70 or 74 can be mistaken, when selected, from each other.

Second Embodiment

Figure 6:
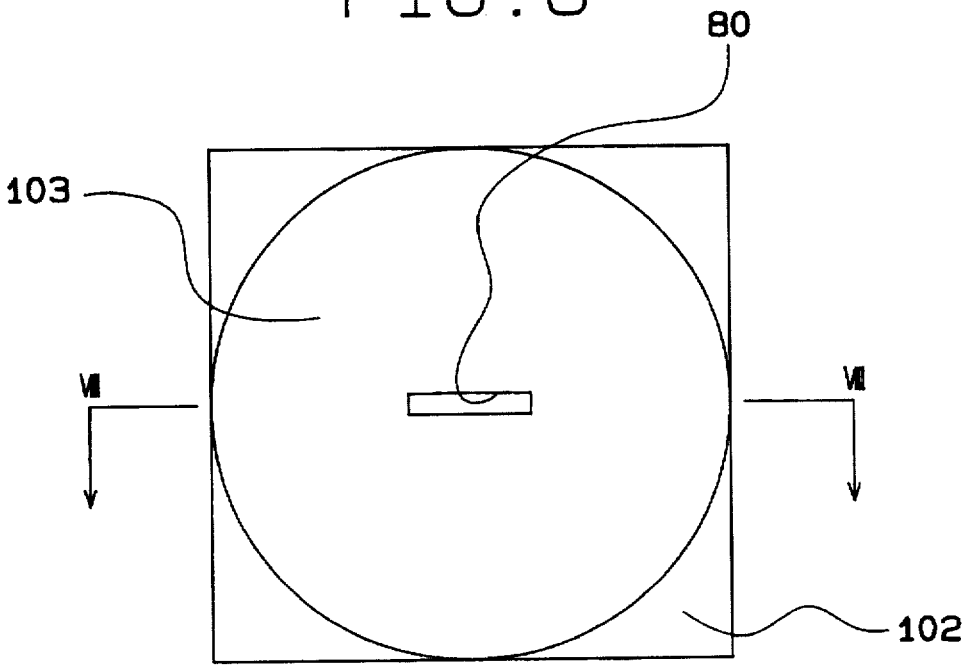
FIG. 6 is a bottom view of a fluid injection nozzle of a second embodiment of the present invention.
Figure 7:
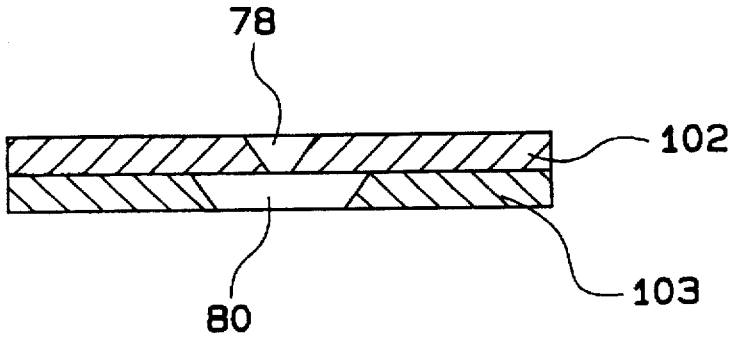
FIG. 7 is a section taken along line VII—VII of FIG. 6.

The second embodiment of the present invention is shown in FIGS. 6 and 7.

In the second embodiment shown in FIGS. 6 and 7, a first orifice plate 102 is made of a square thin plate, and a second orifice plate 103 is made of a circular thin plate. The inscribed circle of the four sides of the first orifice plate 102 corresponds to the outer circumference of the second orifice plate 103. The shapes and positional relations of the first and second orifices 78 and 80 are similar to those of the first embodiment.

According to this second embodiment, there is achieved an effect that the upper and lower plates can be easily discriminated and prevented from being erroneously assembled because they are given the different shapes, i.e., the square shape and the circular shape.

Third Embodiment

Figure 9:
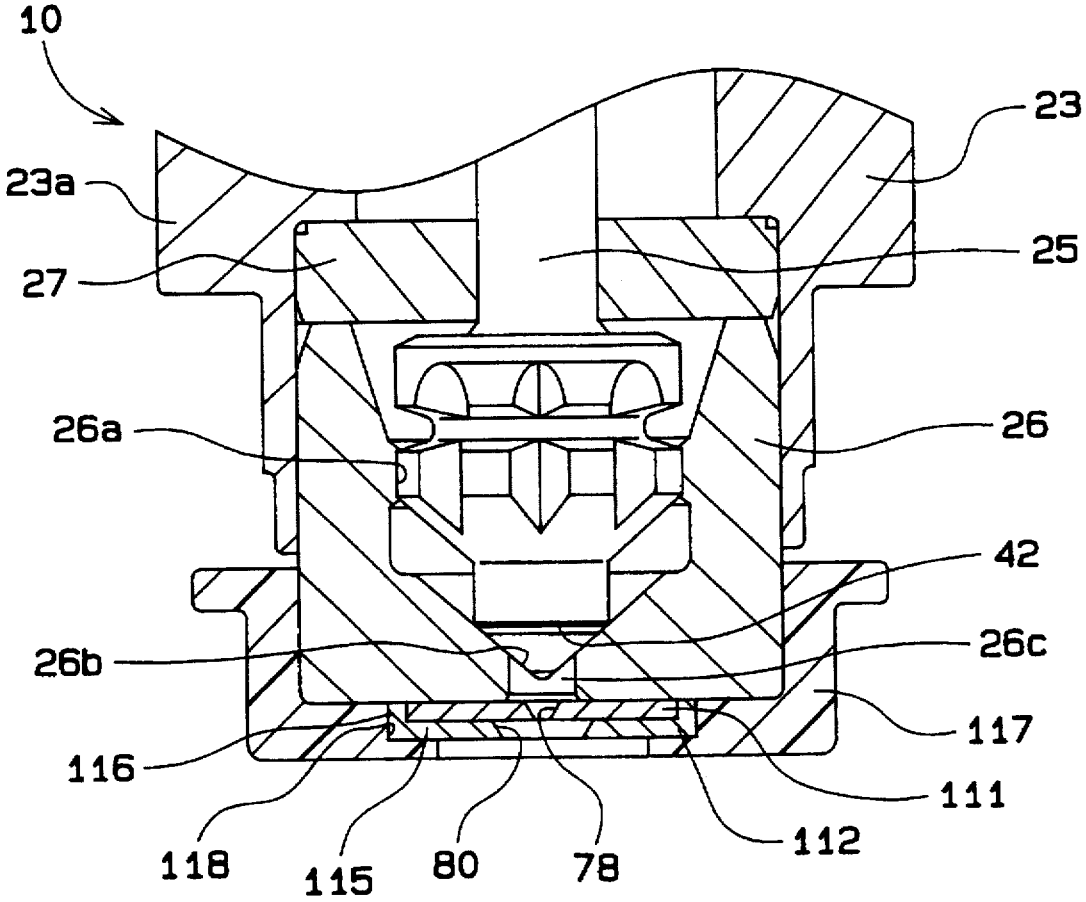
FIG. 9 is an enlarged section of an essential portion of the third embodiment of the present invention.
Figure 8:
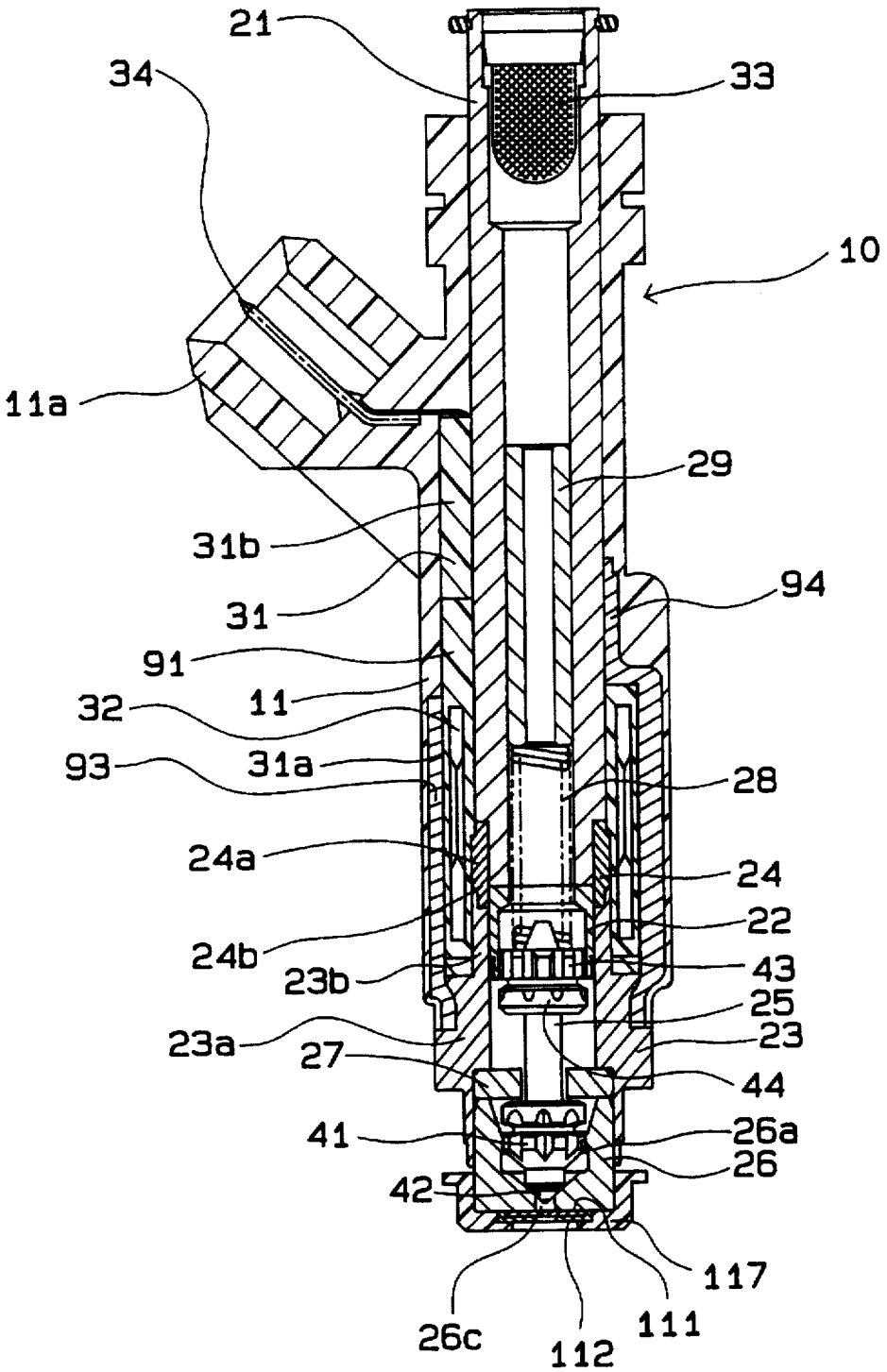
FIG. 8 is a section of a third embodiment, in which the fluid injection nozzle of the present invention is applied to the fuel injection valve.

The third embodiment of the present invention is shown in FIGS. 8 and 9.

In the third embodiment shown in FIGS. 8 and 9, a second orifice plate 112 is formed of a disc portion 115 and an annular ridge 116 formed on the outer circumference of the circular disc portion 115. A circular first orifice plate 111 is fitted in the annular ridge 116 and is laser-welded liquid-tight thereto. Moreover, the first orifice plate 111 is formed with the first orifice 78, and the second orifice plate 112 is formed with the second orifice 80. A sleeve 117 is formed with a fitting hole 118 for fitting the second orifice plate 112 therein.

At the assembling time, the first orifice plate 111 is placed on the disc portion 115 of the second orifice plate 112. These second and first orifice plates 112 and 111 are laser-welded to the valve body 26, and the sleeve 117 is press-fixed in the valve body 26.

According to the this third embodiment, the first orifice plate 111 and the second orifice plate 112 are fitted so that they can be easily assembled in the valve body 26 when they are to be laser-welded. Thanks to the different shapes of the first and second orifice plates, the upper and lower orifice plates can be discriminated from each other. Thanks to the asymmetric front and back, moreover, the second orifice plate can be discriminated in its sides. Thus, there is achieved another effect that an erroneous assembly can be avoided.

Fourth Embodiment

Figure 10:
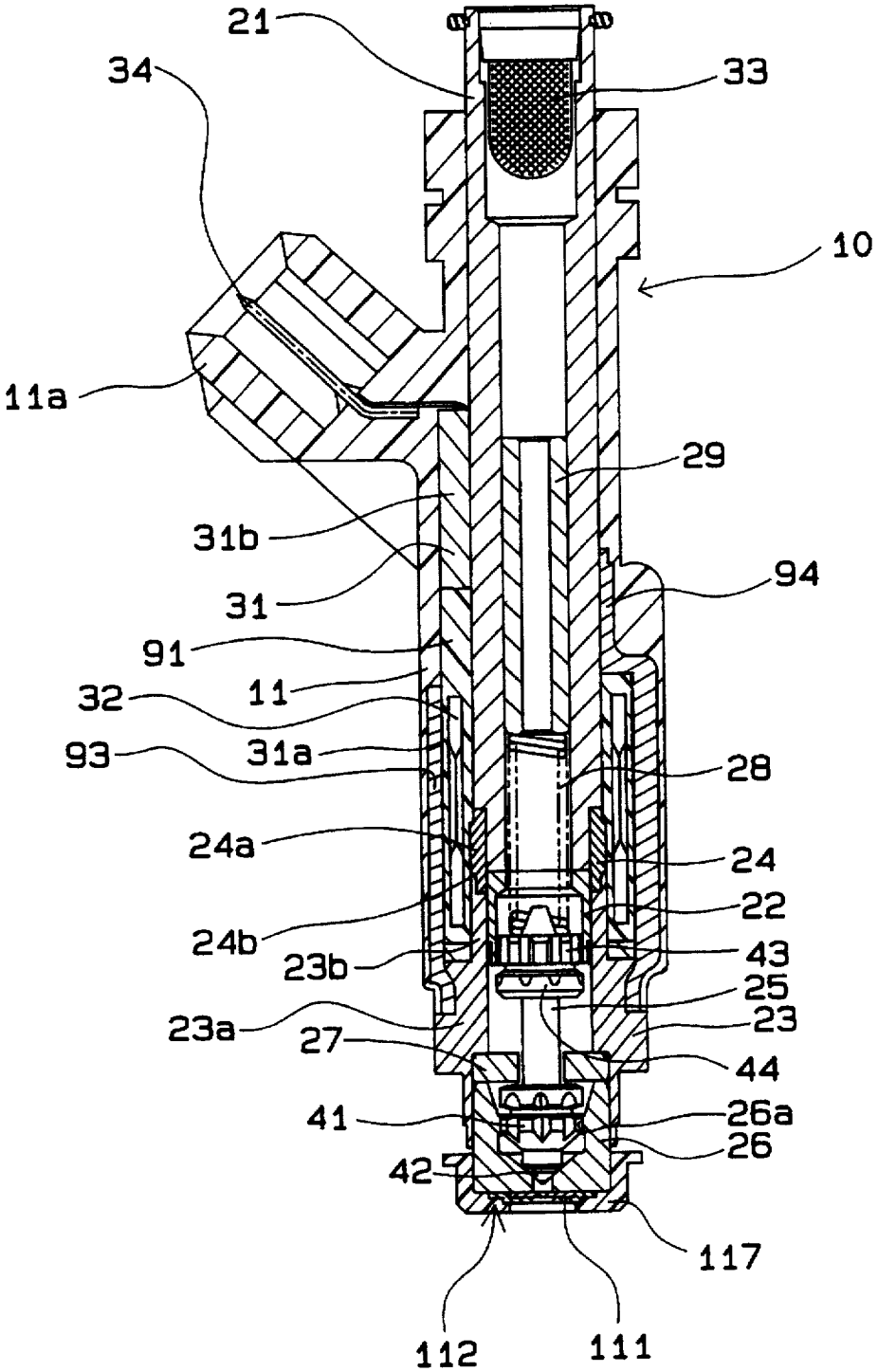
FIG. 10 is a section of a fourth embodiment, in which the fluid injection nozzle of the present invention is applied to the fuel injection valve.
Figure 11:
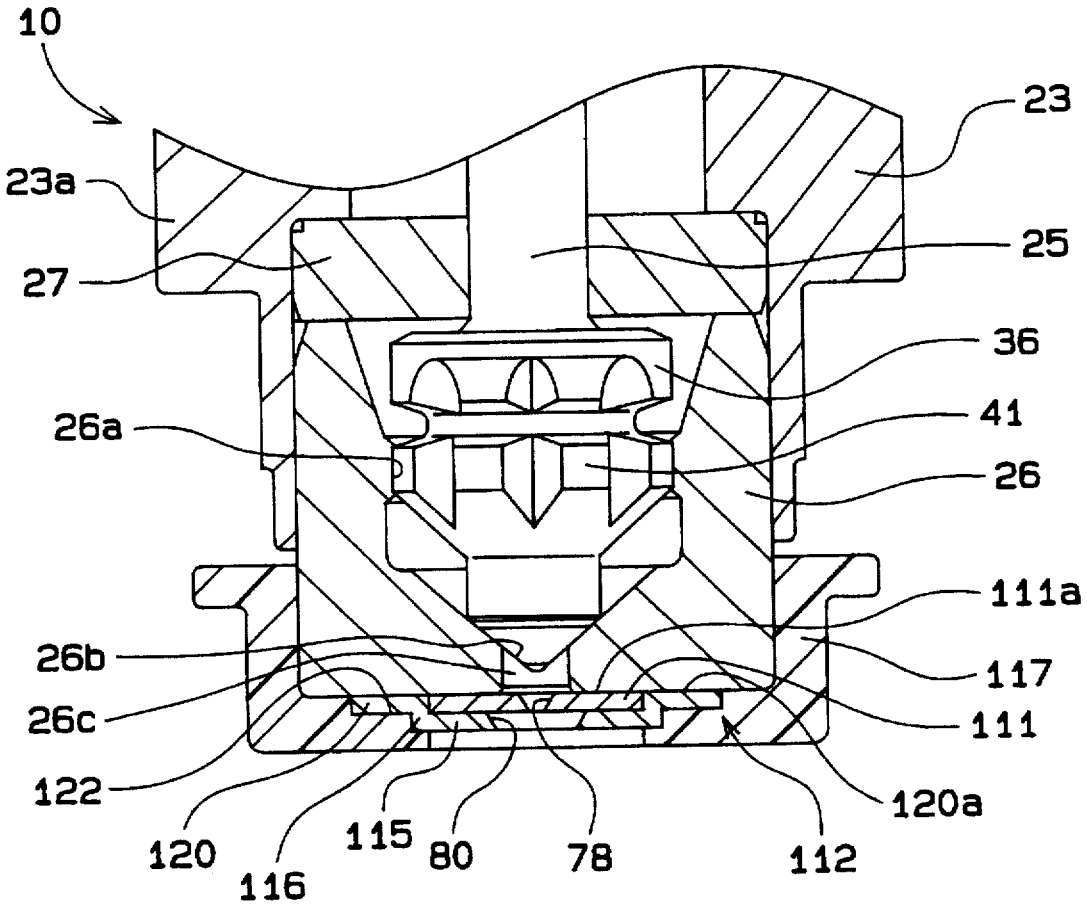
FIG. 11 is an enlarged section of an essential portion of the fourth embodiment of the present invention.

The fourth embodiment of the present invention is shown in FIGS. 10 and 11.

In the fourth embodiment shown in FIG. 10 and 11, the second orifice plate 112 is further formed with an annular flange portion 120 on the outer circumference of the annular ridge 116. The first orifice plate 111 has its end face 111*a* belonging to the common plane of the end face 120*a* of the flange portion 120 of the second orifice plate 112. The sleeve 117 is formed with a circular stepped groove 122 for fitting the second orifice plate 112 therein.

At the assembling time, the first orifice plate 111 is fitted in the second orifice plate 112, and these first and second orifice plates 111 and 112 are fixed on the valve body 26 by the laser-welding.

In this fourth embodiment, too, the first and second orifice plates 111 and 112 are given the different shapes so that they can be easily discriminated when assembled. As a result, a metering member composed of the first and second orifice plates 111 and 112 at the exit of the injection port 26*c* of the valve body 26 can be easily assembled in the valve body 26. On the other hand, these first and second orifice plates can be discriminated from each other because they are given the different shapes. Moreover, the second orifice plate can be discriminated in its two sides because its front and back are asymmetric. Thus, there is achieved an effect that the erroneous assembly can be avoided.

Fifth Embodiment

Figure 12:
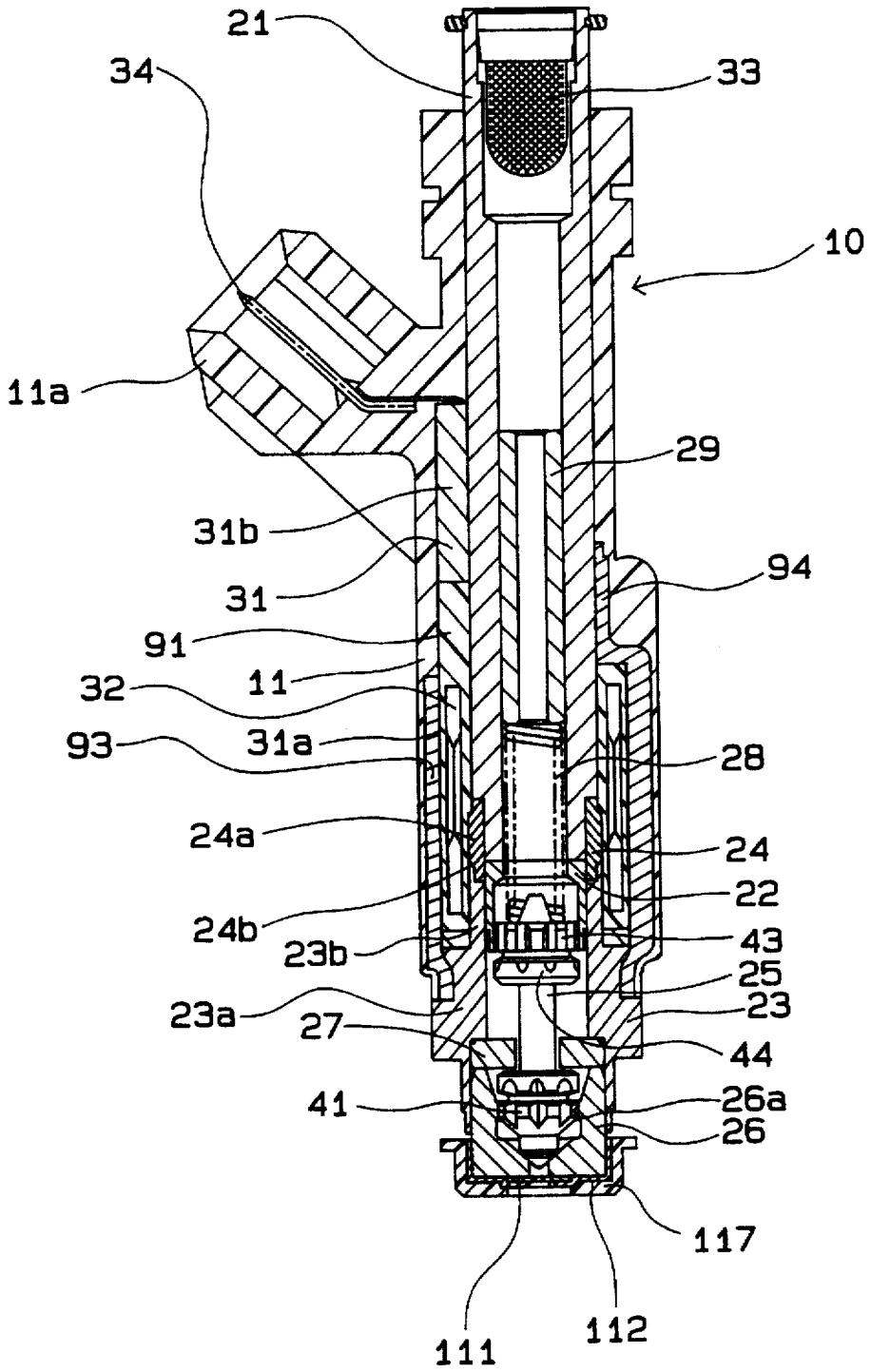
FIG. 12 is a section of a fifth embodiment, in which the fluid injection nozzle of the present invention is applied to the fuel injection valve.
Figure 13:
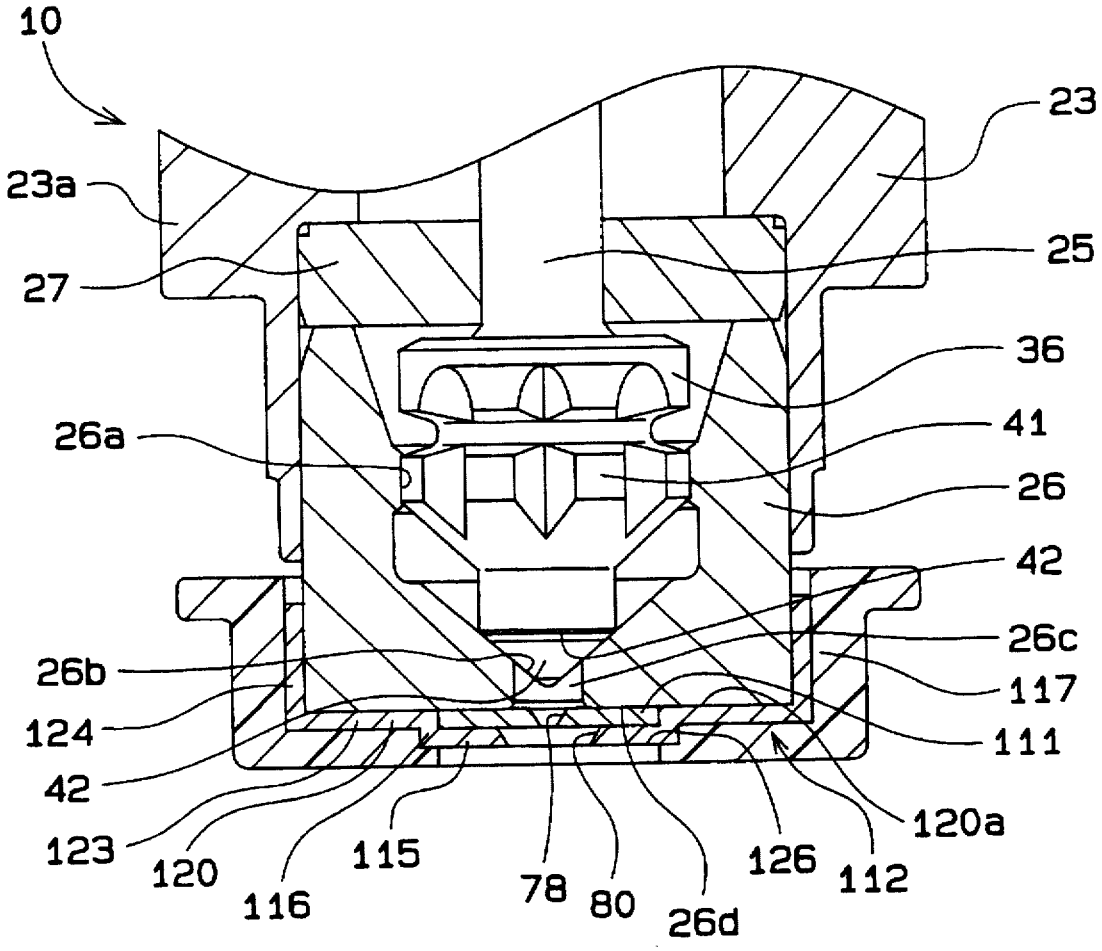
FIG. 13 is an enlarged section of an essential portion of the fifth embodiment of the present invention.

The fifth embodiment of the present invention is shown in FIGS. 12 and 13.

In the fifth embodiment shown in FIGS. 12 and 13, the flange portion 120 of the second orifice plate 112 of the fourth embodiment, as shown in FIG. 11, is formed of a radially externally extended portion 123 and a cap portion 124.

As in the aforementioned embodiment, the first orifice plate 111 is formed with the first orifice 78, and the second orifice plate 112 is formed with the second orifice 80.

The second orifice plate 112 is composed of the extended portion 123 and the cap-shaped cap portion 124 in addition to the disc portion 115, the annular ridge 116 and the flange portion 120. The disc portion 115 is formed with the second orifice 80. The extended portion 123 is an annular portion radially externally extended to the outer circumferential edge of the valve body 26. The cap portion 124 is formed into such a cap shape as is cylindrically extended at a right angle from the outer circumferential edge of the extended portion 123. The cap portion 124 thus formed is fitted on the outer circumference of the valve body 26.

The sleeve 117 is formed with a stepped groove 126 corresponding to the contour of the second orifice plate 112 for fitting the second orifice plate 112.

At the assembling time, the first orifice plate 111 is fitted in the central portion of the second orifice plate 112 so that the first and second orifice plates 111 and 112 are integrated to abut against the end face 26*d* of the valve body 26. These first and second orifice plates 111 and 112 are fixed on the valve body 26 by the laser welding, and the sleeve 117 is then press-fixed on the cap portion 124.

According to this fifth embodiment, too, the first and second orifice plates 111 and 112 can be easily discriminated when assembled, because they are given the different shapes. As a result, the metering member composed of the first and second orifice plates 111 and 112 can be easily assembled on the valve body 26. Moreover, the second orifice plate 112 can be discriminated in its two sides because its front and back are asymmetric. Thus, the plates can be discriminated in their upper and lower positions and their fronts and backs to provide the effect that they can be prevented from being erroneously assembled.

Sixth Embodiment

Figure 14:
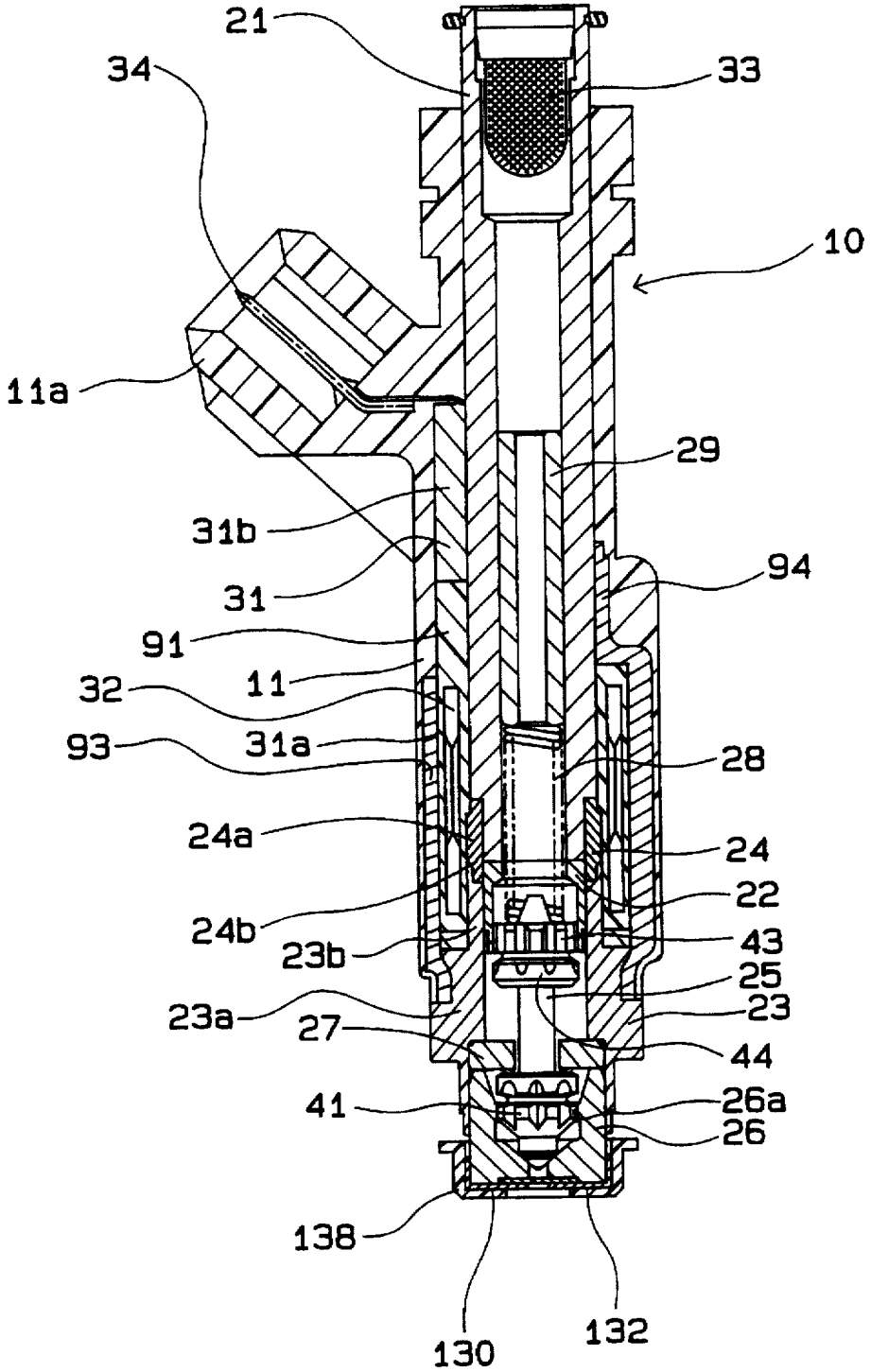
FIG. 14 is a section of a sixth embodiment, in which the fluid injection nozzle of the present invention is applied to the fuel injection valve.
Figure 15:
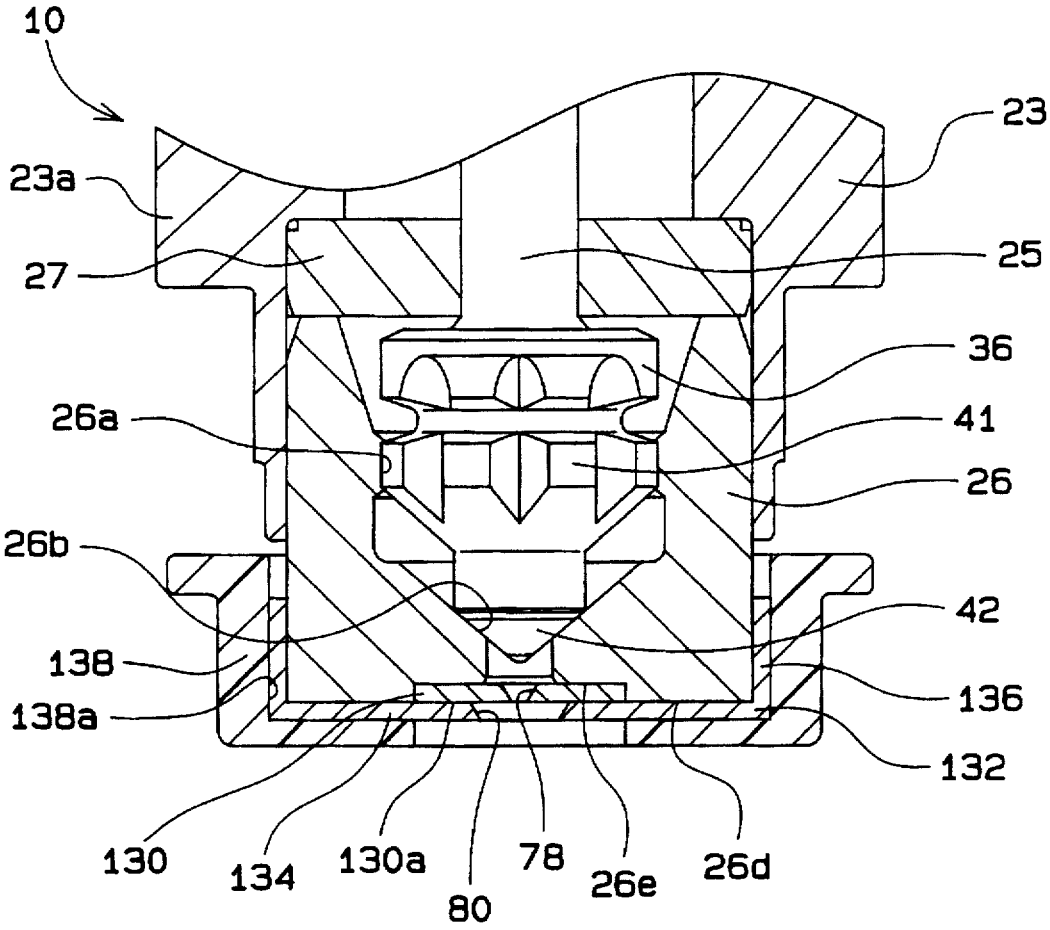
FIG. 15 is an enlarged section of an essential portion of the sixth embodiment of the present invention.

The sixth embodiment of the present invention is shown in FIGS. 14 and 15.

In the sixth embodiment shown in FIGS. 14 and 15, the valve body 26 is formed in its end face 26*d* with a groove 26*e* which is made as thick as a first orifice plate 130 for fitting the first orifice plate 130 therein.

The first orifice plate 130 is shaped to correspond to the groove 26*e* of the valve body 26 and given a thickness equal to the depth of the groove 26*e*. Moreover, this first orifice plate 130 is formed with the first orifice 78 in its central portion.

A second orifice plate 132 is formed of a flat plate portion 134 to abut against the end face 130*a* of the first orifice plate 130 and the end face 26*d* of the valve body 26, and a cap portion 136 formed in a cap shape to rise at a right angle from the flat plate portion 134. The flat plate portion 134 is formed with the second orifice 80 at its central portion. The cap portion 136 is sized to be fitted on the outer circumferential portion of the valve body 26.

A sleeve 138 is formed with an inner wall 138*a* which is shaped to correspond to the outer wall of the second orifice plate 132 for fitting the second orifice plate 132.

At the assembling time, the first orifice plate 130 is fitted in the groove 26*e* of the valve body 26, and the second orifice plate 132 is then fitted on the first orifice plate 130. These first and second orifice plates 130 and 132 are fixed on the valve body 26 by the laser welding, and the sleeve 138 is press-fixed.

According to this sixth embodiment, the valve body 26 has its end face 26*d* cut to form the groove 26*e* so that the first and second orifice plates 130 and 132 and the sleeve 138 can be given the remarkably simple shapes to provide an effect that the production cost can be reduced. There is achieved another effect that the erroneous assembly can be prevented, because the first and second orifice plates can be given the different shapes to facilitate their vertical locations and because they can be made asymmetric in their two sides to facilitate their fronts and backs.

The welding operations of the orifice plates on the injection in the foregoing first to sixth embodiments can be exemplified by: (1) welding the first orifice plate on the needle body and then the second orifice plate; (2) welding the second orifice plate together with the first orifice plate extending from the second orifice plate; (3) welding the first orifice plate and the second orifice plate along their full peripheries and then welding the two to the needle body with the first one extending from the second one; and (4) point-welding the first and second orifice plates and then welding the two to the needle body with the first orifice plate extending from the second orifice plate.

Seventh Embodiment

Figure 16:
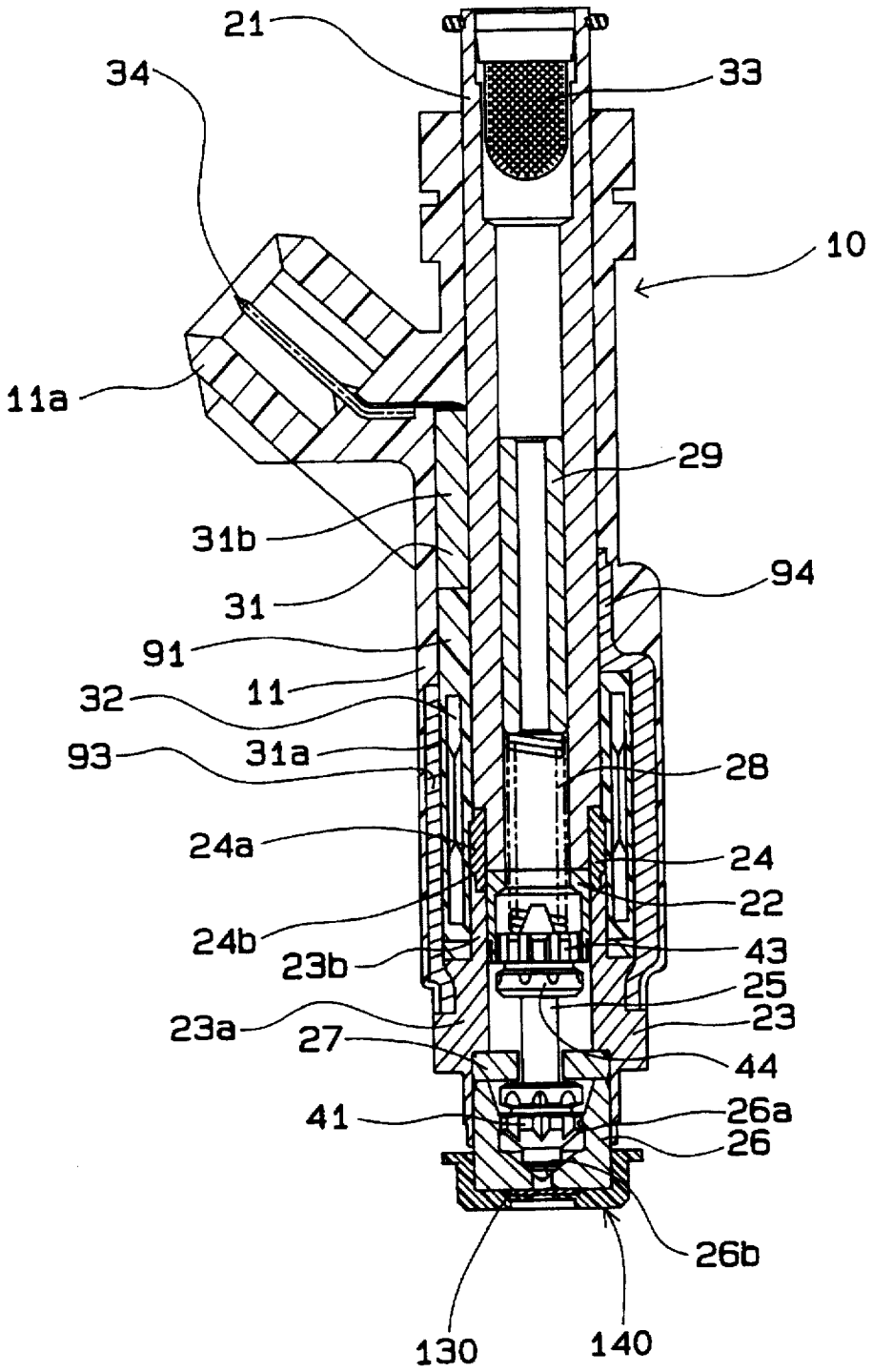
FIG. 16 is a section of a seventh embodiment, in which the fluid injection nozzle of the present invention is applied to the fuel injection valve.
Figure 17:
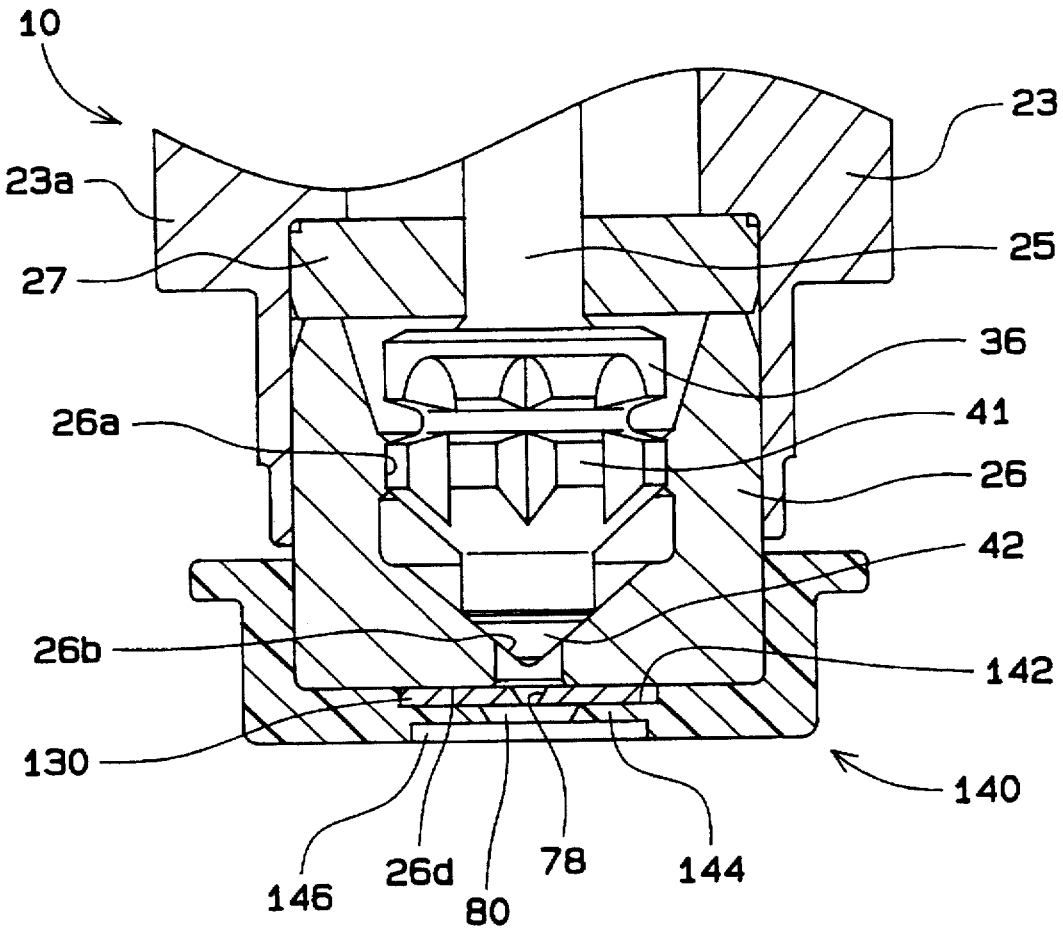
FIG. 17 is an enlarged section of an essential portion of the seventh embodiment of the present invention.
Figure 18:
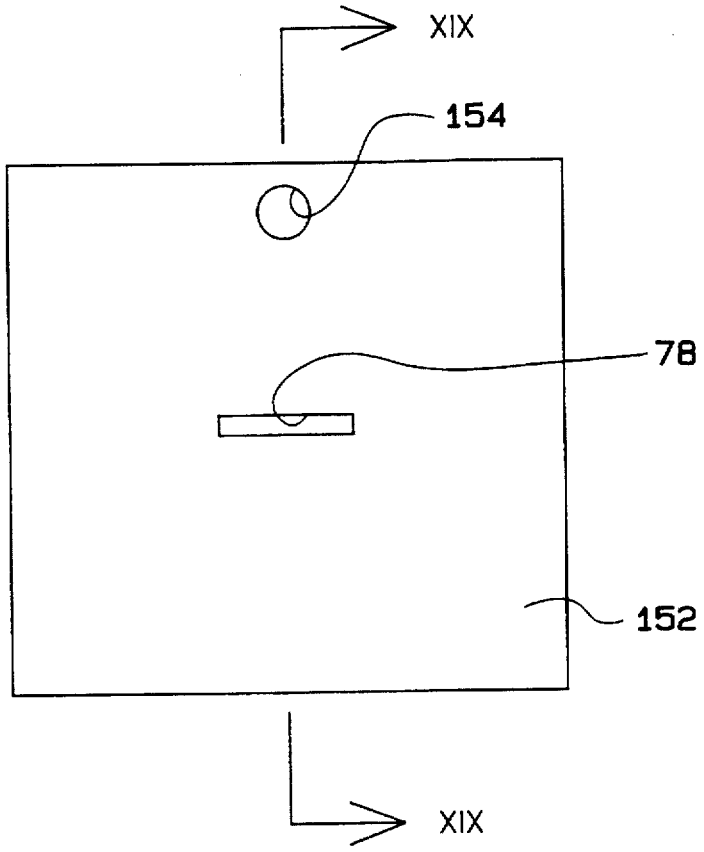
FIG. 18 is a bottom view showing a fluid injection nozzle of an eighth embodiment of the present invention.

The seventh embodiment of the present invention is shown in FIGS. 16 and 17.

In the seventh embodiment shown in FIGS. 16 and 17, the sleeve itself is formed with the second orifice.

The first orifice plate 130 is formed with the first orifice 78 in its central portion. A sleeve 140 is formed with a groove portion 142 which is contoured to the shape of and given the same thickness as those of the first orifice plate 130 so as to fit the same therein. This groove portion 142 is formed in a second orifice plate portion 144. This second orifice plate portion 144 is made integral with the sleeve 140 and formed with the second orifice 80 at its central portion. A groove portion 146, as located at the side opposed in the thickness direction of the second orifice plate 144, is formed in the outer wall of the sleeve 140.

At the assembling time, the first orifice plate 130 is laser-welded to the end face 26*d* of the valve body 26, and the sleeve 140 is press-fixed. Alternatively, the orifice plate 130 may be fitted in the groove portion 142 of the sleeve 140 so that it may be press-fixed together with the sleeve 140 on the valve body 26.

According to this seventh embodiment, the second orifice plate 144 is made integral with the sleeve 140 so that the one component, i.e., the second orifice plate can be dispensed with to provide an effect the assembling operation can be simplified because of the reduction in the number of parts. Thanks to the different shapes, moreover, the first and second orifice plates can be vertically discriminated. Thanks to the asymmetric sides, still moreover, the second orifice plate can be discriminated in its front and back. As a result, there is achieved another effect that the erroneous assembly can be prevented. As in the foregoing embodiments, similarly excellent fuel atomization characteristics can be achieved by the first and second orifices 78 and 80.

Although, in the foregoing first to seventh embodiments, the first and second orifice plates are discriminated as to their upstream and downstream sides from their overall sizes and shapes, they may be discriminated from their colors or from the sizes, shapes or colors of their portions. In the third to fifth embodiments, moreover, the two sides of the second orifice plate are discriminated from the different shapes at its front and back. However, the two sides of the first orifice plate may be discriminated by giving different shapes, sizes or colors to its front and back. These differences need not be whole but may be partial.

In eighth, ninth, tenth and eleventh embodiments to be disclosed, technical devices have been made to facilitate the positionings of the first and second orifice plates and accordingly their assembly on the needle body.

These technical devices are characterized in that the following items are clearly discriminated to facilitate the assembling operations: (1) the positional relation between the relative angles between the first and second orifices at the mating face between the upper first and lower second orifice plates; (2) the vertical positional relation on which of the first and second orifice plates is the upper one; and (3) the positional relation on which of the front and back of one orifice plate is exposed.

Eighth Embodiment

The eighth embodiment shown in FIGS. 18 to 23 is directed to the device (1), in which the first orifice plate and the second orifice plate are so easily positioned that the relative angles at their mating faces may coincide.

Figure 19:
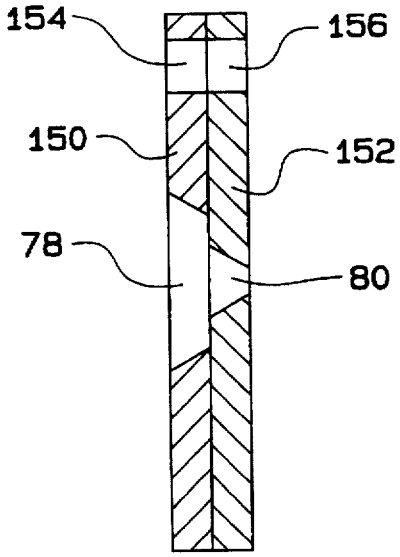
FIG. 19 is a section taken along line XIX—XIX of FIG. 18.
Figure 20:
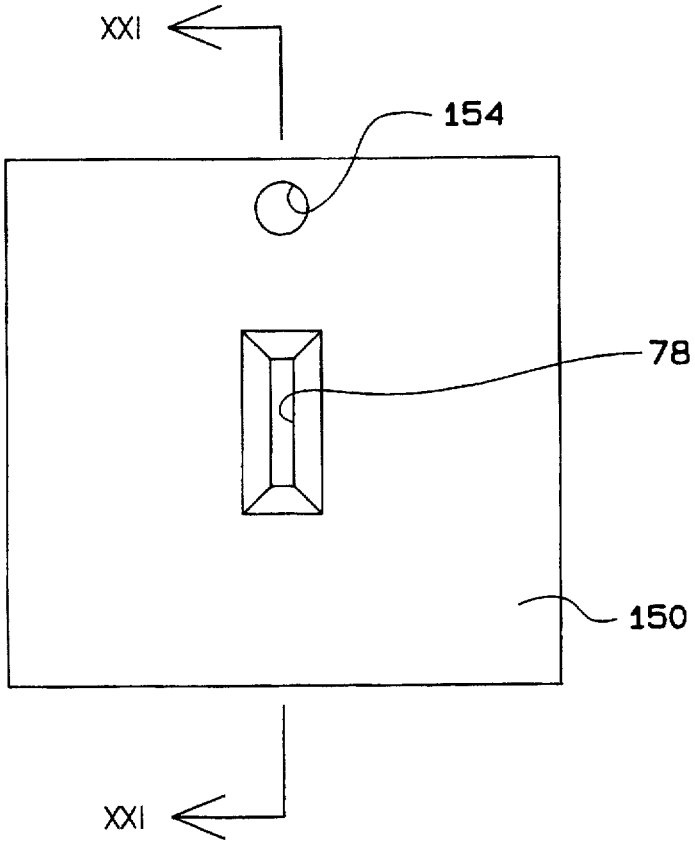
FIG. 20 is a top plan view of a first orifice plate of the eighth embodiment of the present invention.
Figure 21:
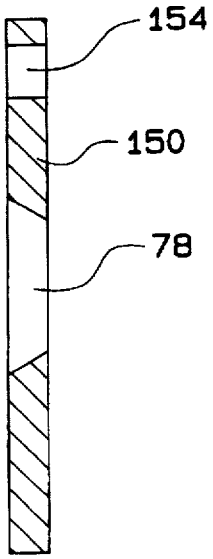
FIG. 21 is a section taken along line XXI—XXI of FIG. 20.
Figure 22:
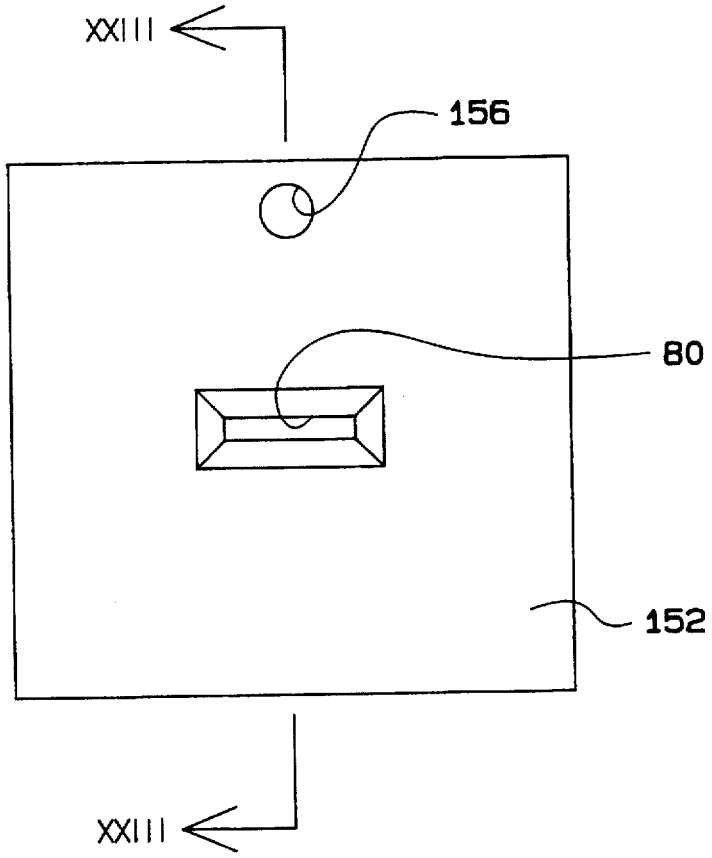
FIG. 22 is a top plan view of a second orifice plate of the eighth embodiment of the present invention.
Figure 23:
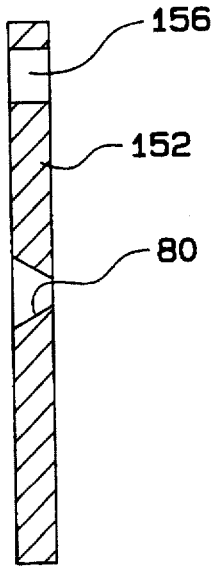
FIG. 23 is a section taken along line XXIII—XXIII of FIG. 22.

The first orifice plate 150 and the second orifice plate 152 are respectively formed with positioning holes 154 and 156 in their corresponding positions. The first and second orifice plates 150 and 152 can be easily positioned relative to each other by superposing the plates 150 and 152 such that their positioning holes 154 and 156 may be aligned with each other, as shown in FIG. 19. At this positioning time, the first orifice 78 and the second orifice 80 are directed at a right angle.

Ninth Embodiment

The ninth embodiment of the present invention is shown in FIGS. 24 to 29.

The ninth embodiment shown in FIGS. 24 to 29 is directed to a structure in which the upper first orifice plate and the lower second orifice plate are easily discriminated together with the relative angular positions of their flat plate faces.

The first orifice plate 160 is made of a thin plate having a square shape and formed at its central portion with the first orifice 78, which is formed the first positioning hole 154 having a circular shape in the vicinity of the outer circumferential edge in the longitudinal direction of the groove of the first orifice 78.

The second orifice plate 162 is made of a thin plate having a circular shape and is formed at its central portion with the second orifice 80, which is formed into a groove extending longitudinally at a right angle with respect to the first orifice 78, and the second positioning hole 156 having a circular shape similar to that of the first positioning hole 154 in the vicinity of the outer circumferential edge in the longitudinal direction at a right angle with respect to the longitudinal direction of thereof. The second orifice plate 162 has its external diameter set to that of the circle which is inscribed on the four sides of the first orifice plate 160.

Figure 24:
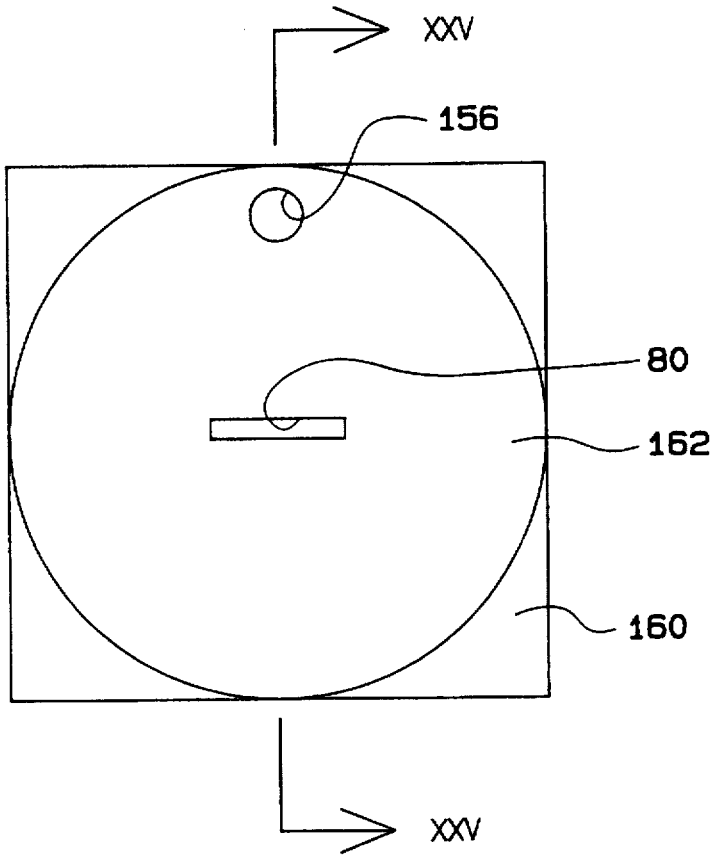
FIG. 24 is a bottom view showing a fluid injection nozzle of a ninth embodiment of the present invention.
Figure 25:
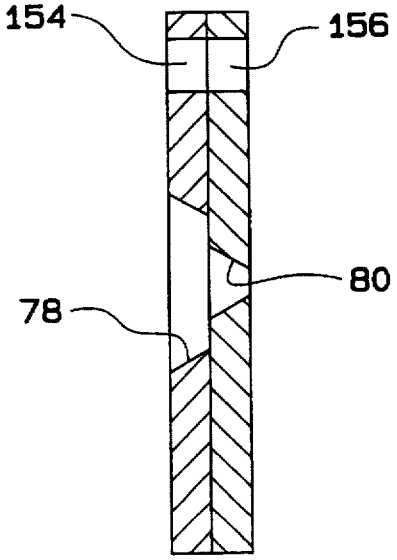
FIG. 25 is a section taken along line XXV—XXV of FIG. 24.
Figure 26:
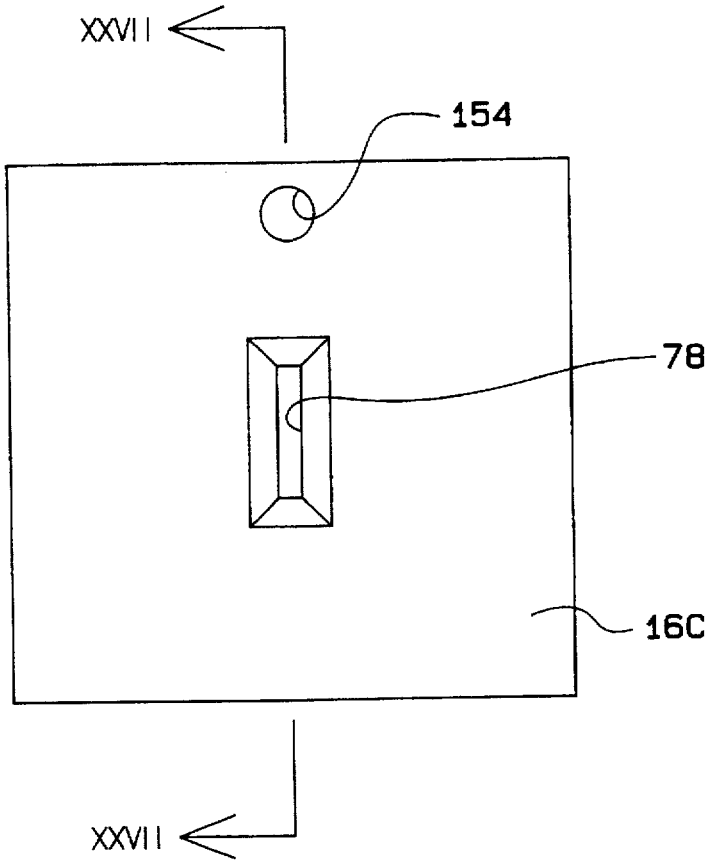
FIG. 26 is a top plan view of a first orifice plate of the ninth embodiment of the present invention.
Figure 27:
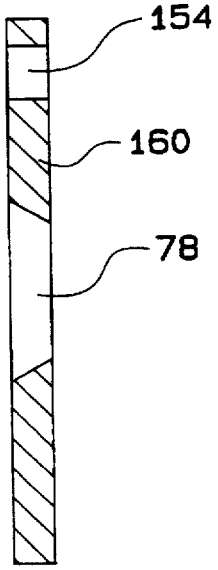
FIG. 27 is a section taken along line XXVII—XXVII of FIG. 26.
Figure 28:
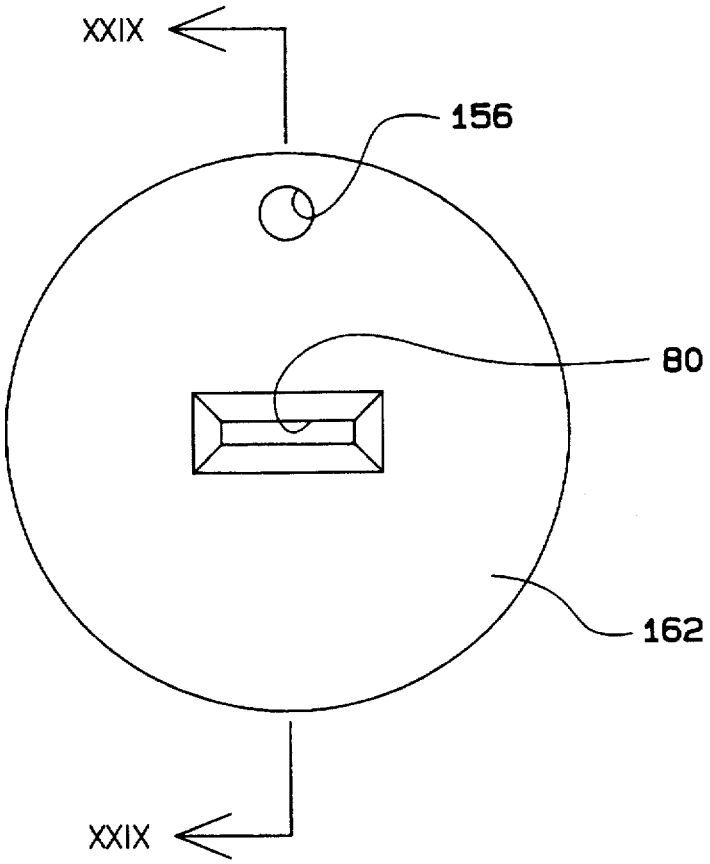
FIG. 28 is a top plan view of a second orifice plate of the ninth embodiment of the present invention.
Figure 29:
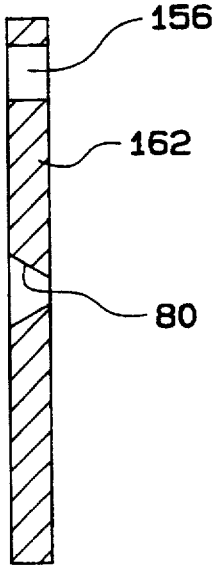
FIG. 29 is a section taken along line XXIX—XXIX of FIG. 28.
Figure 30:
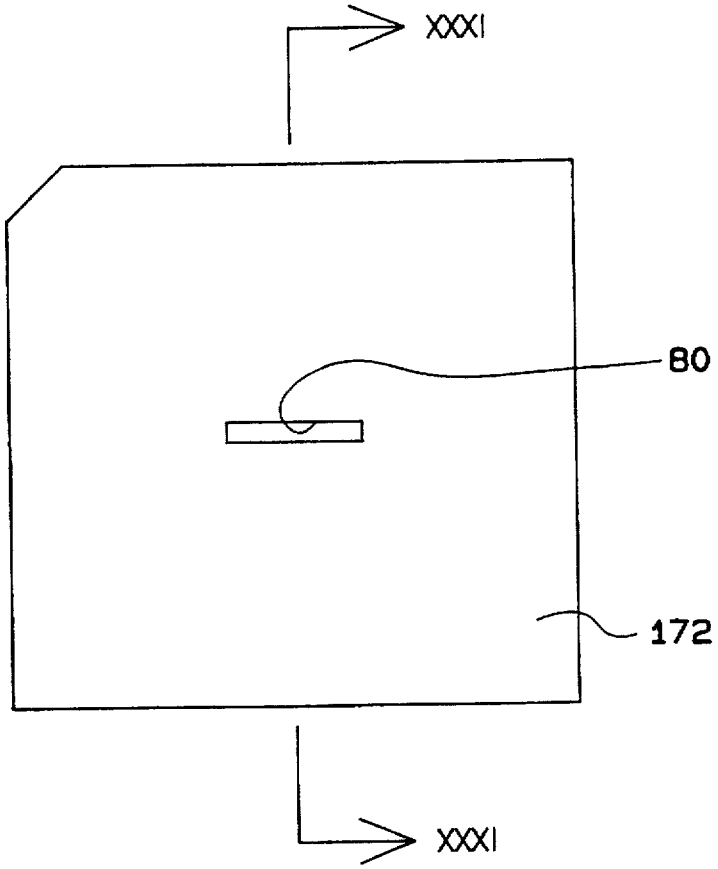
FIG. 30 is a bottom view showing a fluid injection nozzle of a tenth embodiment of the present invention.
Figure 31:
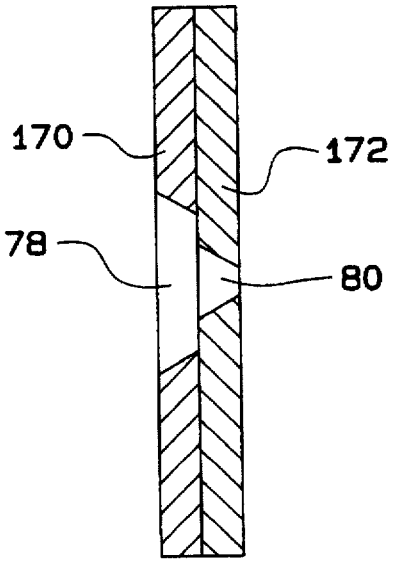
FIG. 31 is a section taken along line XXXI—XXXI of FIG. 30.
Figure 32:
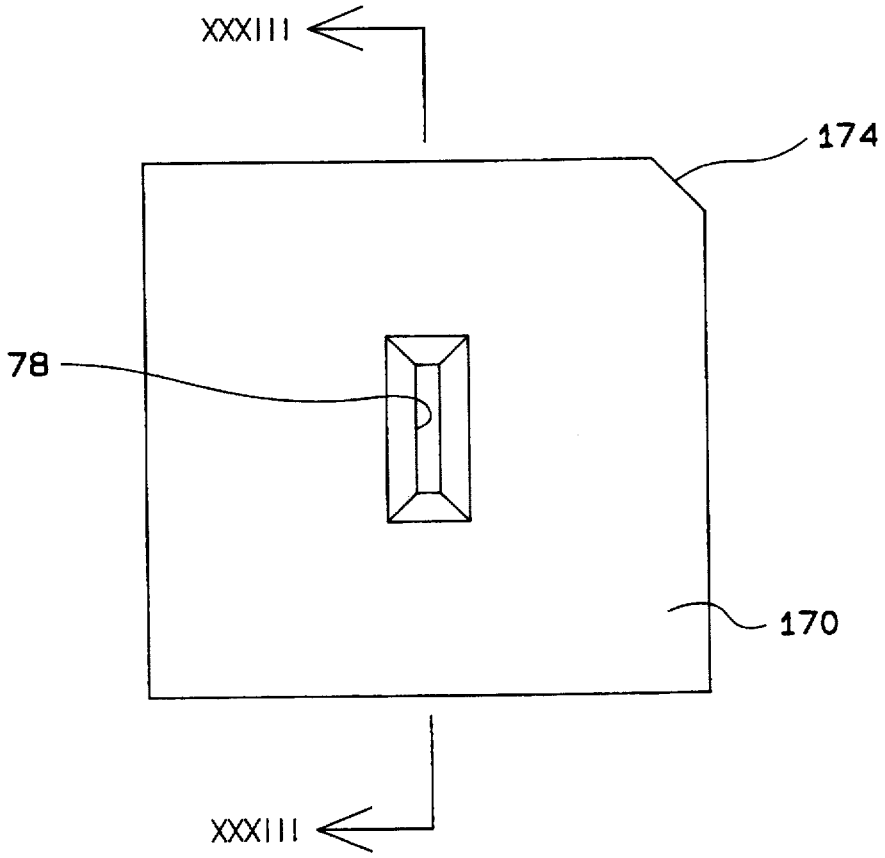
FIG. 32 is a top plan view of a first orifice plate of the tenth embodiment of the present invention.
Figure 33:
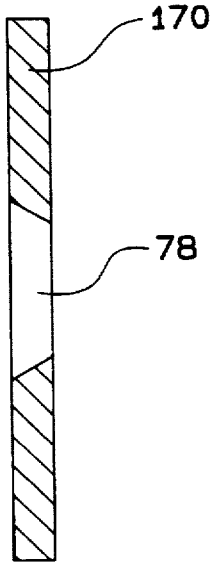
FIG. 33 is a section taken along line XXIII—XXIII of FIG. 32.
Figure 34:
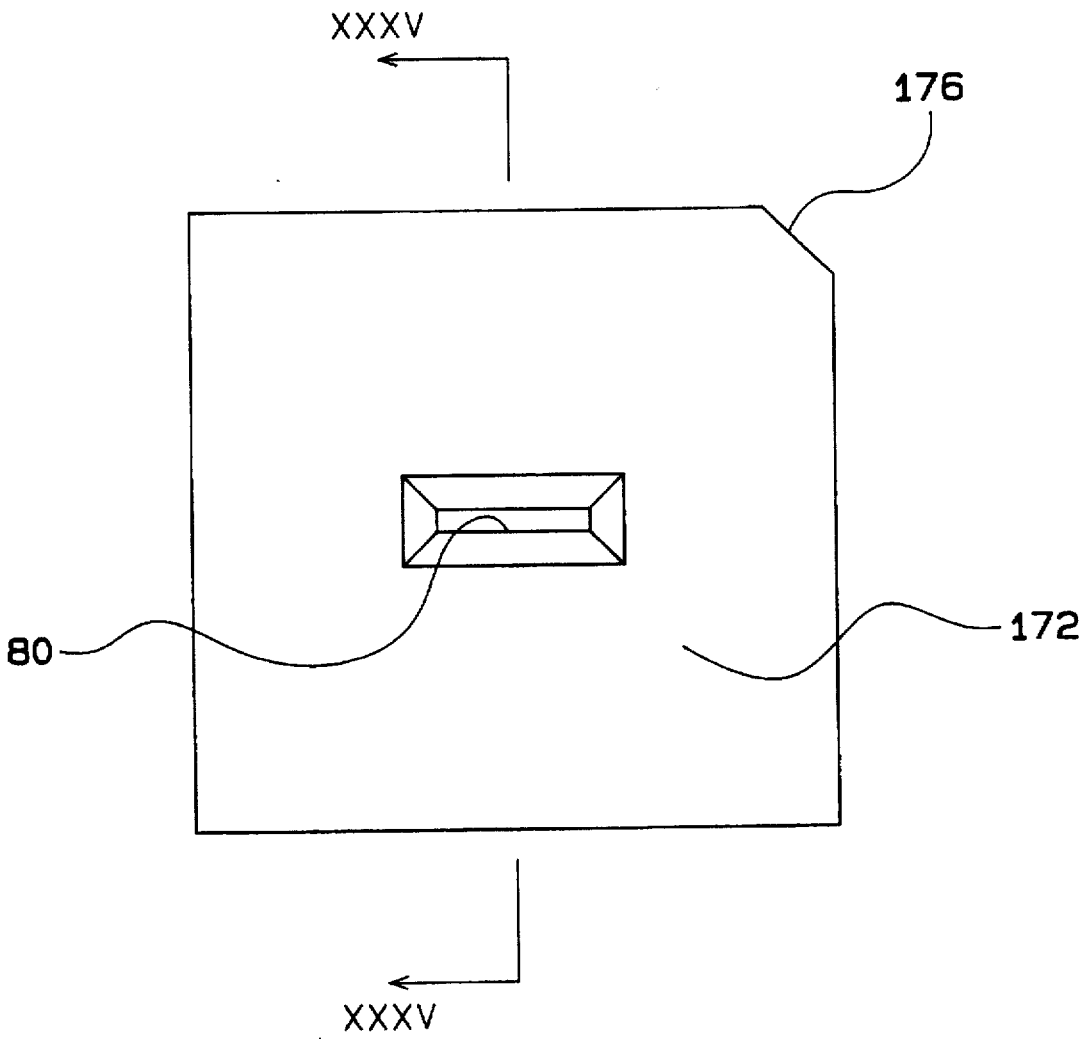
FIG. 34 is a top plan view of a second orifice plate of the tenth embodiment of the present invention.
Figure 35:
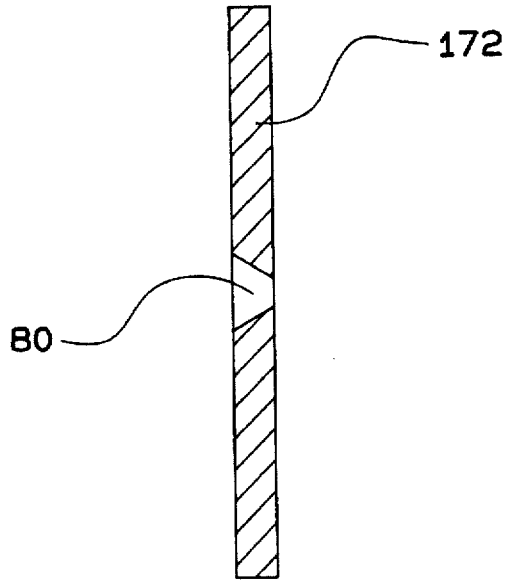
FIG. 35 is a section taken along line XXV—XXV of FIG. 34.

According to this ninth embodiment, when the lower second orifice plate 162 is superposed on the upper first orifice plate 160, the first positioning hole 154 and the second positioning hole 156 are aligned with each other, as shown in FIGS. 24 and 25, to establish the through hole of the equal diameter. According to this embodiment, there are achieved the effects that the two orifice plates 160 and 162 can be easily positioned in their relative angles by superposing their positioning holes 154 and 156, and that the upper and lower plates can be easily discriminated and assembled because the upper one has the square shape whereas the lower one has the circular shape.

Tenth Embodiment

The tenth embodiment of the present invention is shown in FIGS. 30 to 35.

In the tenth embodiment shown in FIGS. 30 to 35, the first orifice plate and the second orifice plate are notched at their corners so that their relative angular positions may be adjusted by the positioning notches.

The first orifice plate 170 is made of a thin plate having a square shape and is formed at its central portion with the first orifice 78 having an elongated groove shape. This first orifice plate 170 is formed at its one corner with a positioning notch 174.

The second orifice plate 174 is formed with the second orifice 80 having an elongated groove shape extending at a right angle with respect to the first orifice 78. This second orifice plate 172 is also formed with a second positioning notch 176 which is positioned to correspond to the first positioning notch 174 of the first orifice plate 170.

At the assembling time, the first orifice plate 170 and the second orifice plate 172 are superposed so that they can be easily positioned in respect of their relative angles by registering the first and second positioning notches 174 and 176.

Eleventh Embodiment

Figure 36:
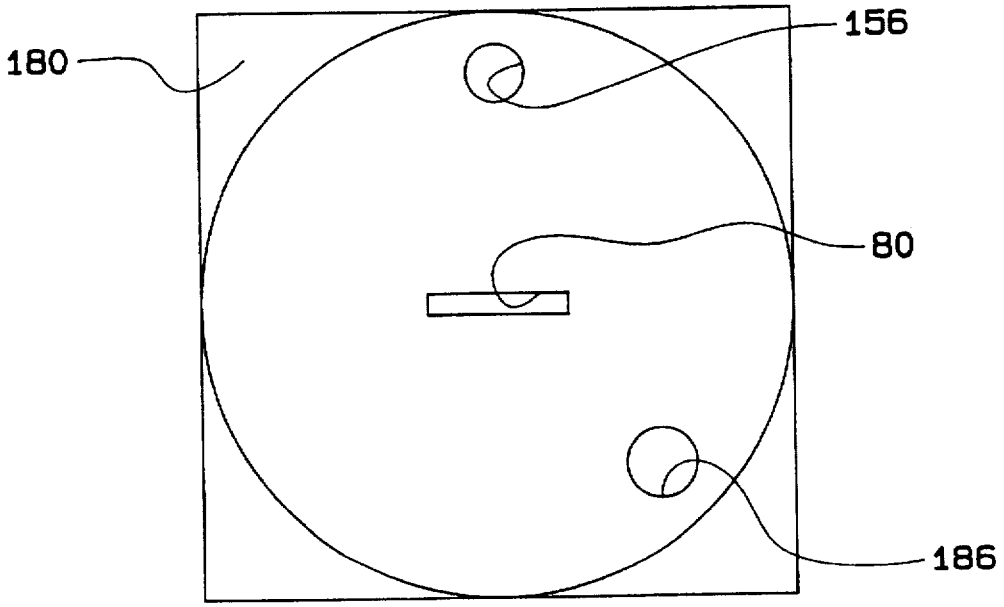
FIG. 36 is a bottom view showing a fluid injection nozzle of an eleventh embodiment of the present invention.
Figure 37:
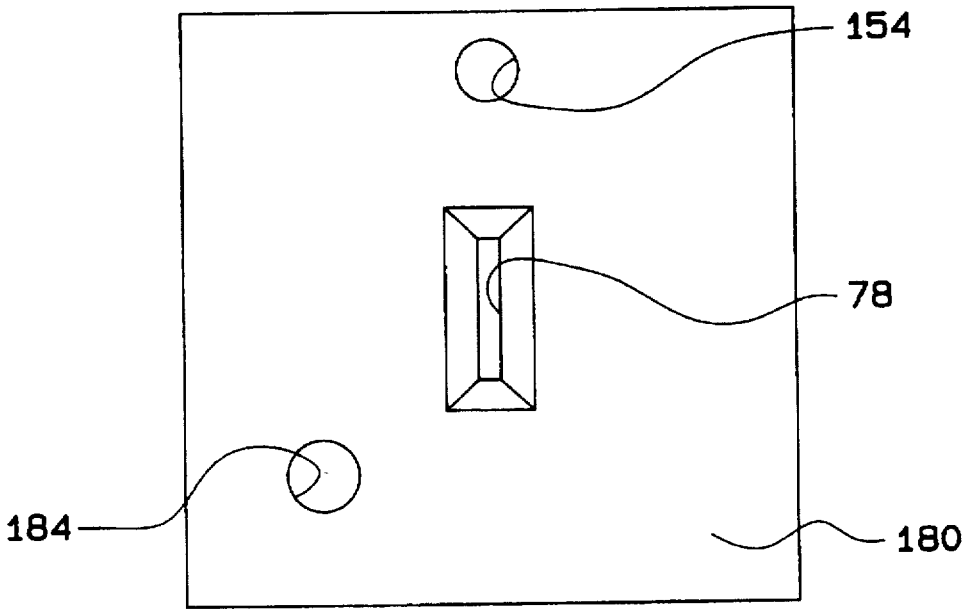
FIG. 37 is a top plan view of a first orifice plate of the eleventh embodiment of the present invention.
Figure 38:
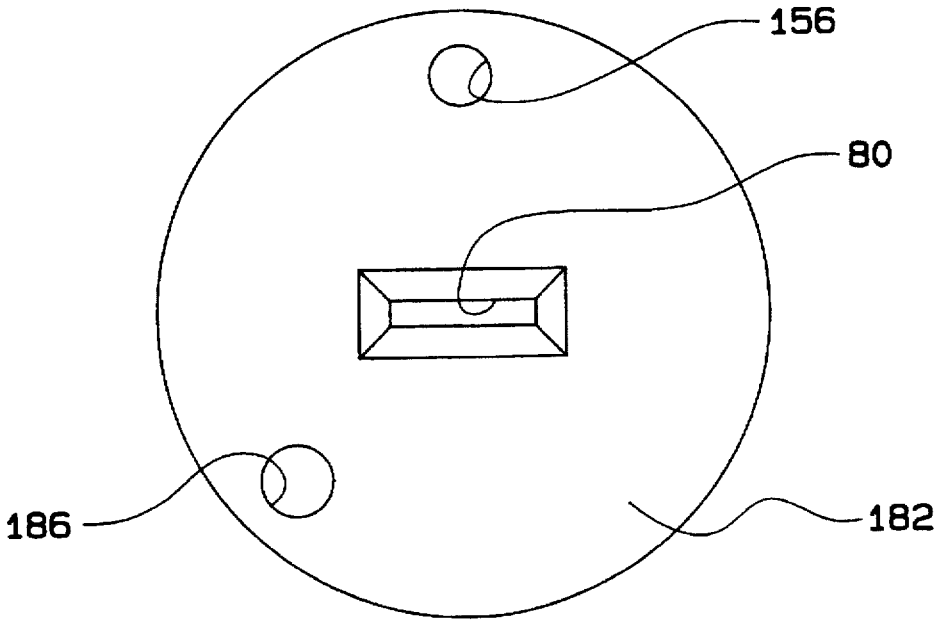
FIG. 38 is a top plan view of a second orifice plate of the eleventh embodiment of the present invention.

The eleventh embodiment of the present invention is shown in FIGS. 36 to 38.

The eleventh embodiment shown in FIGS. 36 to 38 is so devised in shape as to facilitate the discriminations of: (1) relative positions; (2) vertical positions; and (3) fronts and backs of the first and second orifice plates.

The first orifice plate 180 is made of a thin plate having a square shape and is formed at its central portion with the first orifice 78. The first orifice plate 180 is formed in the vicinity of the outer circumferential edge in the longitudinal direction of the first orifice 78 for determining the relative angular positions of the upper and lower orifice plates. Moreover, a side discriminating hole 184 for discriminating the front and back of the first orifice plate 180 is formed in the vicinity of the outer circumferential edge, as located obliquely of the first orifice 78, and is given a diameter different from that of the positioning hole 154 so that these two holes can be avoided from any confusion. The second orifice plate 182 is made of a thin plate having a circular shape and is formed at its central portion with the second orifice 80. The second positioning hole 156 for determining the relative positions of the upper and lower orifice plates is formed in the vicinity of the outer circumferential edge in the longitudinal direction of the second orifice 80. A side discriminating hole 186 for discriminating the front and back of the second orifice plate 182 is formed in the second orifice plate 182 at a position obliquely of the second orifice 80. The positioning hole 156 and the side discriminating hole 186 can be avoided from any confusion as in the first orifice plate by giving them the different diameters. In case the side discriminating hole 184 or 186 is located at the lefthand lower side, as shown in FIGS. 37 or 38, it is possible to discriminate that this side is the upper face.

According to this eleventh embodiment, the upper and lower orifice plates can be determined in their relative angular positions in view of the first and second positioning holes 154 and 156. The upper and lower orifice plates can also be discriminated because the upper one has the square shape whereas the lower one has the circular shape. Moreover, the upper and lower orifice plates 180 and 182 can be individually discriminated as to their fronts and backs in view of the side discriminating holes 184 and 186.

As a result, there can be achieved an effect that the combination and joint of the first and second orifice plates 180 and 182 can be facilitated to improve their assemblability on the needle body.

Moreover, the above-described eighth to eleventh embodiments are directed to the relative positioning of the first and second orifices so that they can be combined with the foregoing first to seventh embodiments.

Twelfth Embodiment

Figure 39:
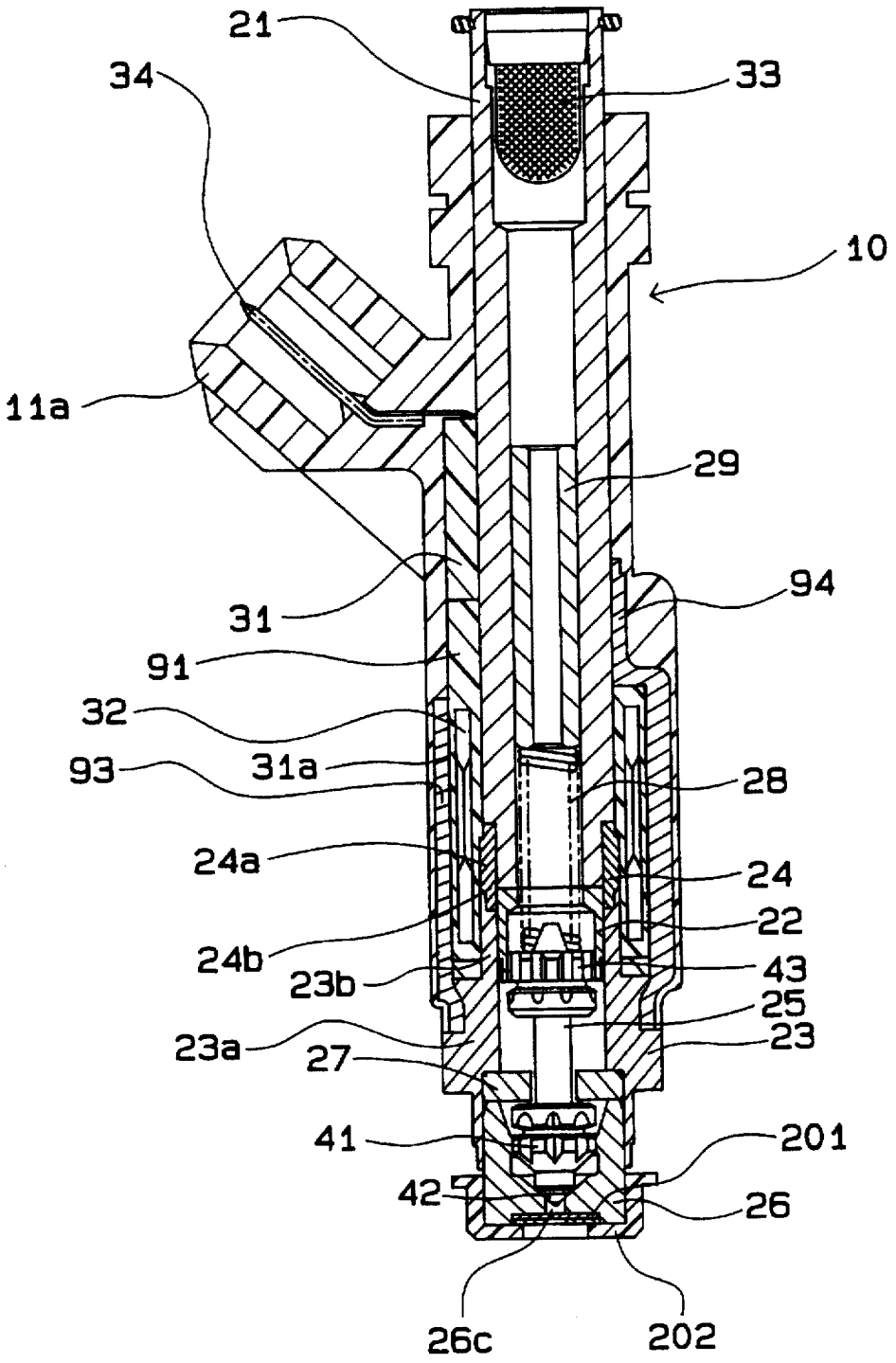
FIG. 39 is a section of a twelfth embodiment, in which a fluid injection nozzle of the present invention is applied to the fuel injection valve.
Figure 40:
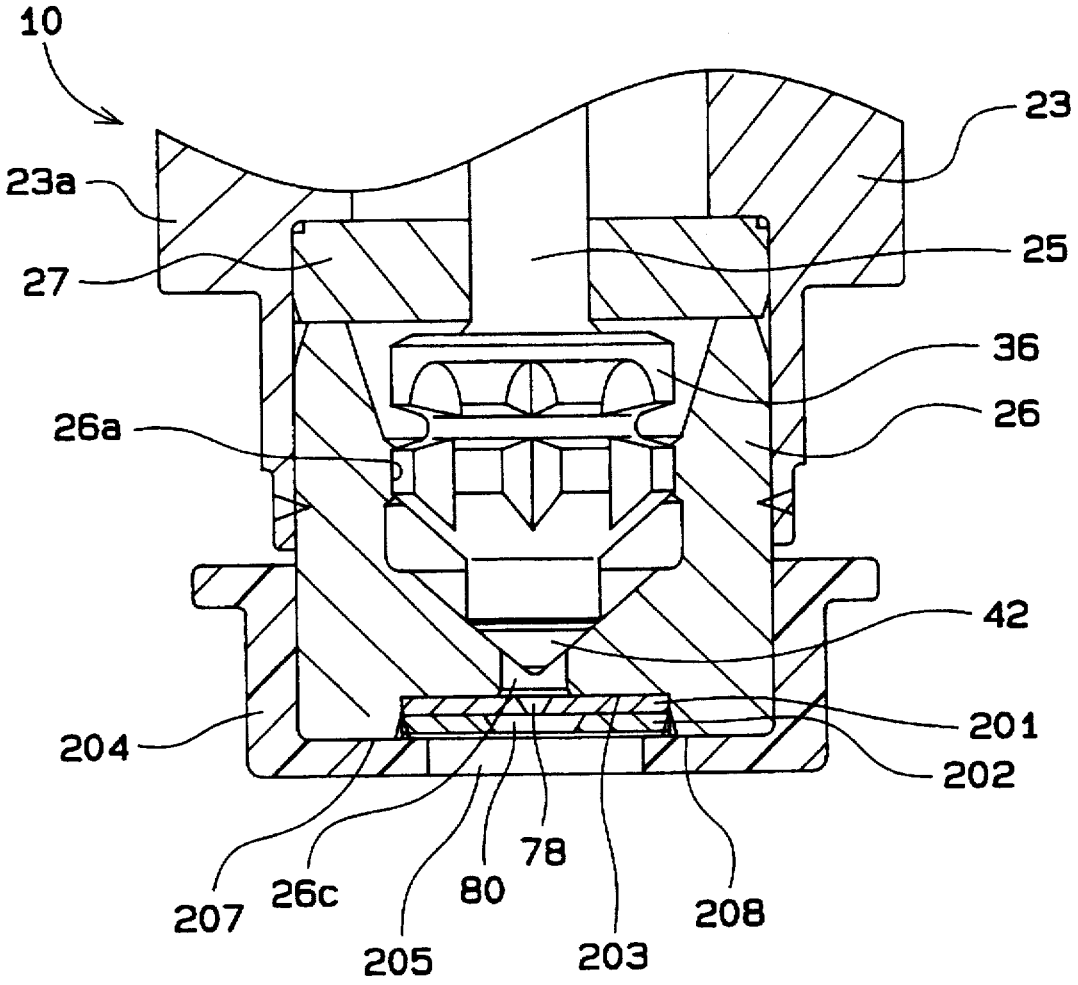
FIG. 40 is an enlarged section of an essential portion of the twelfth embodiment of the present invention.
Figure 41:
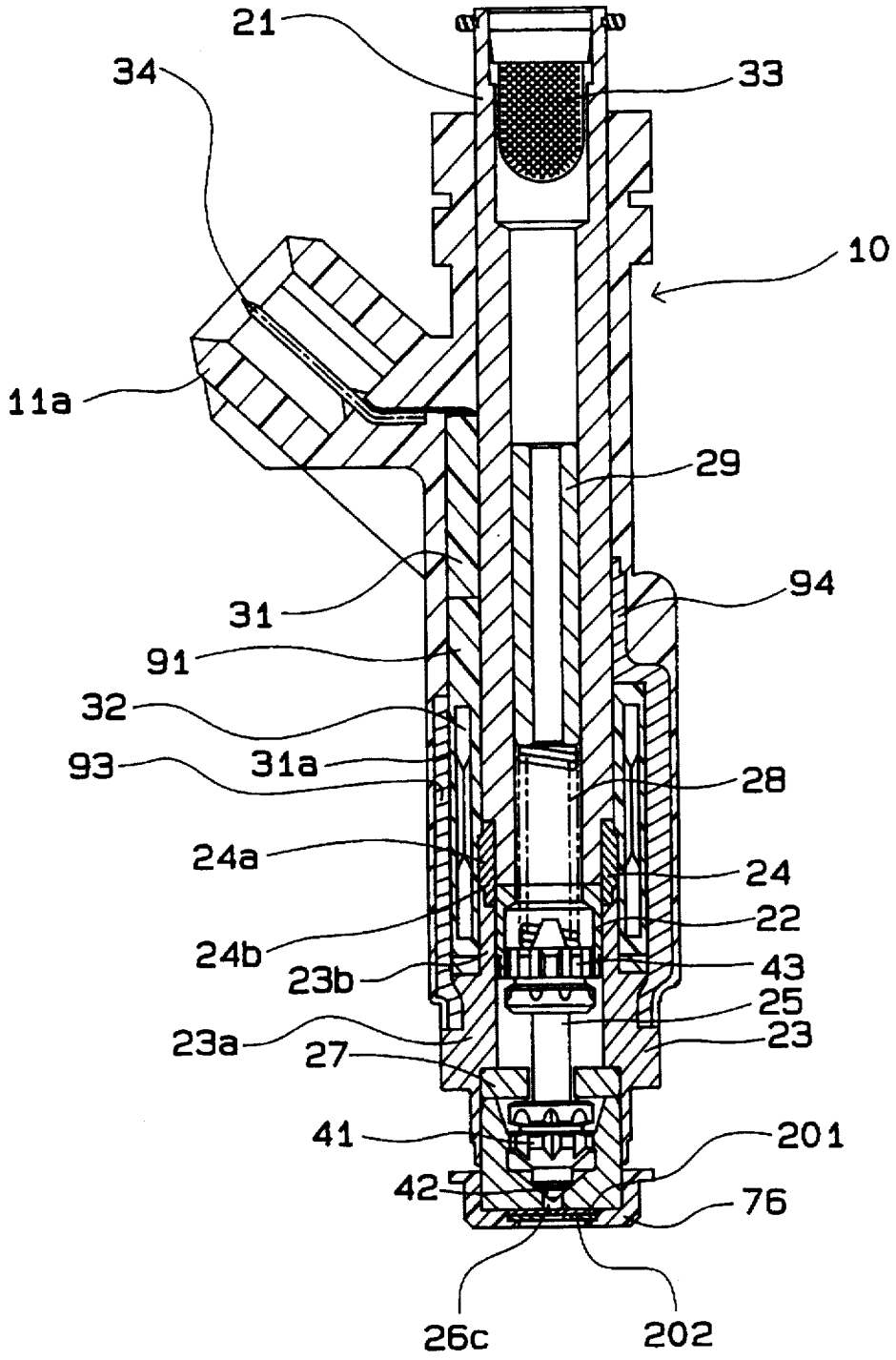
FIG. 41 is a section of a thirteenth embodiment, in which a fluid injection nozzle of the present invention is applied to the fuel injection valve.
Figure 42:
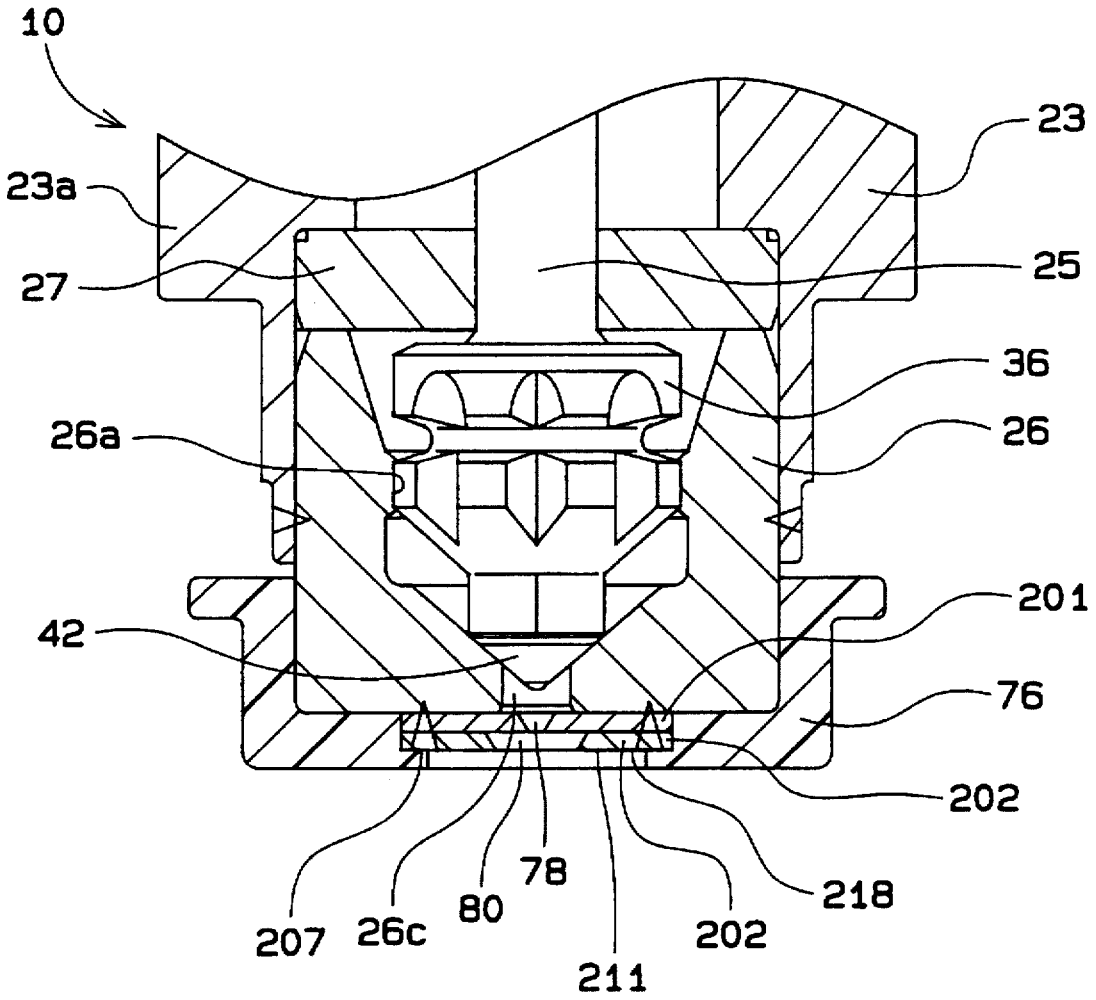
FIG. 42 is an enlarged section of an essential portion of the thirteenth embodiment of the present invention.

The twelfth embodiment of the present invention is shown in FIGS. 39 and 40.

The twelfth embodiment shown in FIGS. 39 and 40 is intended to facilitate the welding operation, when the two orifice plates are to be fixed by the welding on the valve body, and to position the two plates accurately with respect to the valve body thereto to enhance their bonded strength to the valve body.

As shown in FIG. 40, the valve body 26 is formed in its lower end face with a recess 203. This recess 203 is given a square shape, as viewed from the lower side and is made slightly deeper than the total thickness a first orifice plate 201 and a second orifice plate 202. As a result, this recess 203 is formed with the side walls capable of fitting the first and second orifice plates 201 and 202. The first and second orifice plates 201 and 202 have their first and second orifices 78 and 80 arranged at a right angle relative to each other. On the leading end portion of the valve body 26, there is press-fixed a sleeve 204. This sleeve 204 is formed with a through hole 205 which is positioned and sized to raise no obstruction to the fuel flow being atomized through the first and second orifices 78 and 80.

The first orifice plate 201 and the second orifice plate 202 are fitted in the recess 203, and the fitting gaps between the recess 203 and the first and second orifice plates 201 and 202 are vertically welded, as indicated at numerals 207 and 208, throughout their peripheries. As a result, it is possible to enhance the bonded strength of the first and second orifice plates 201 and 202.

At the assembling time, the first and second orifice plates 201 and 202 are superposed with their first and second orifices 78 and 80 being positioned at a right angle relative to each other, as has been described in the foregoing embodiments. The first and second orifice plates 201 and 202 are then fitted in the recess 203. After this fitting operation, the fitted portions are welded all over their peripheries to fix the first and second orifice plates 201 and 202 on the valve body 26. The valve body 26 thus assembled with the first and second orifice plates 201 and 202 is assembled in the injector body and is subjected to the predetermined adjustments and settings. After this, the sleeve 204 is press-fixed on the leading end of the valve body 26.

According to the present embodiment, the recess 203 is worked with reference to the outer circumferential portion of the valve body 26 so that it can be highly accurately cut. Thus, there is achieved an effect that the positioning accuracy of the first and second orifice plates 201 and 202 can be improved.

According to the present embodiment, moreover, the two orifice plates 201 and 202 are positioned in the recess 203 and are welded on the leading end face of the valve body 26 with the welded portions 207 and 208 which fit the first and second orifices 78 and 80 completely in the recess 203.

Thirteenth Embodiment

The thirteenth embodiment of the present invention is shown in FIGS. 41 to 45.

The present embodiment is intended to eliminate the fluctuation of fuel flow rate, which might otherwise accompany the change in the orifice size due to the thermal deformation when the orifice plates are to be welded to the valve body.

In case the two metallic orifice plates are laser-welded along their full peripheries to the valve body, their considerable thicknesses make a considerable amount of thickness necessary to weld them at the same time. This welding energy will change, if as high as the level for the thermal deformation of the orifice plates, the sizes of the openings of their orifices. In this case, there arises a problem that the fuel injection rate changes.

In order to solve this problem, the orifice size change at the instant when the orifice plates 201 and 202 are mounted on the valve body is suppressed by connecting the two them at a plurality of points to the valve body 26.

The first and second orifice plates 201 and 202 are superposed to have their first and second orifices 78 and 80 directed at a right angle with respect to each other. The second orifice plate 202 thus superposed is welded from its lower face 211 at a plurality of points.

Figure 43:
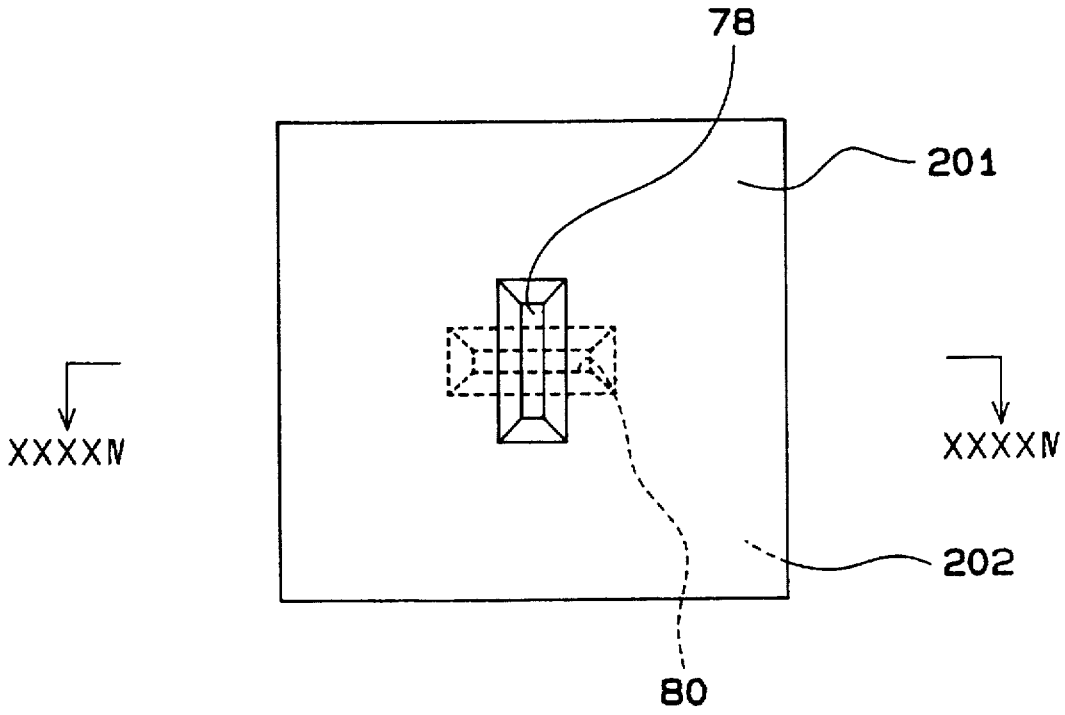
FIG. 43 is a top plan view showing an orifice plate of the thirteenth embodiment of the present invention.
Figure 44:
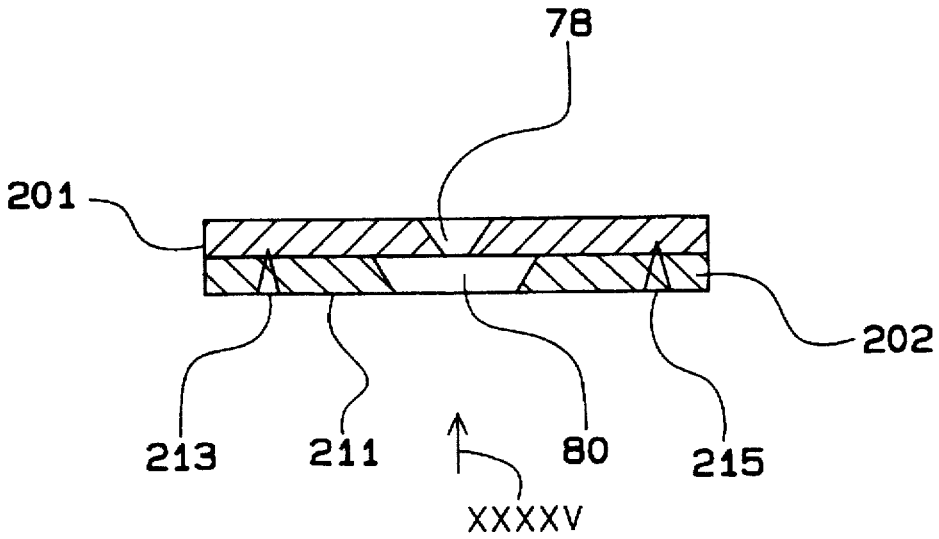
FIG. 44 is a section taken along line XXXXIV—XXXXIV of FIG. 43.
Figure 45:
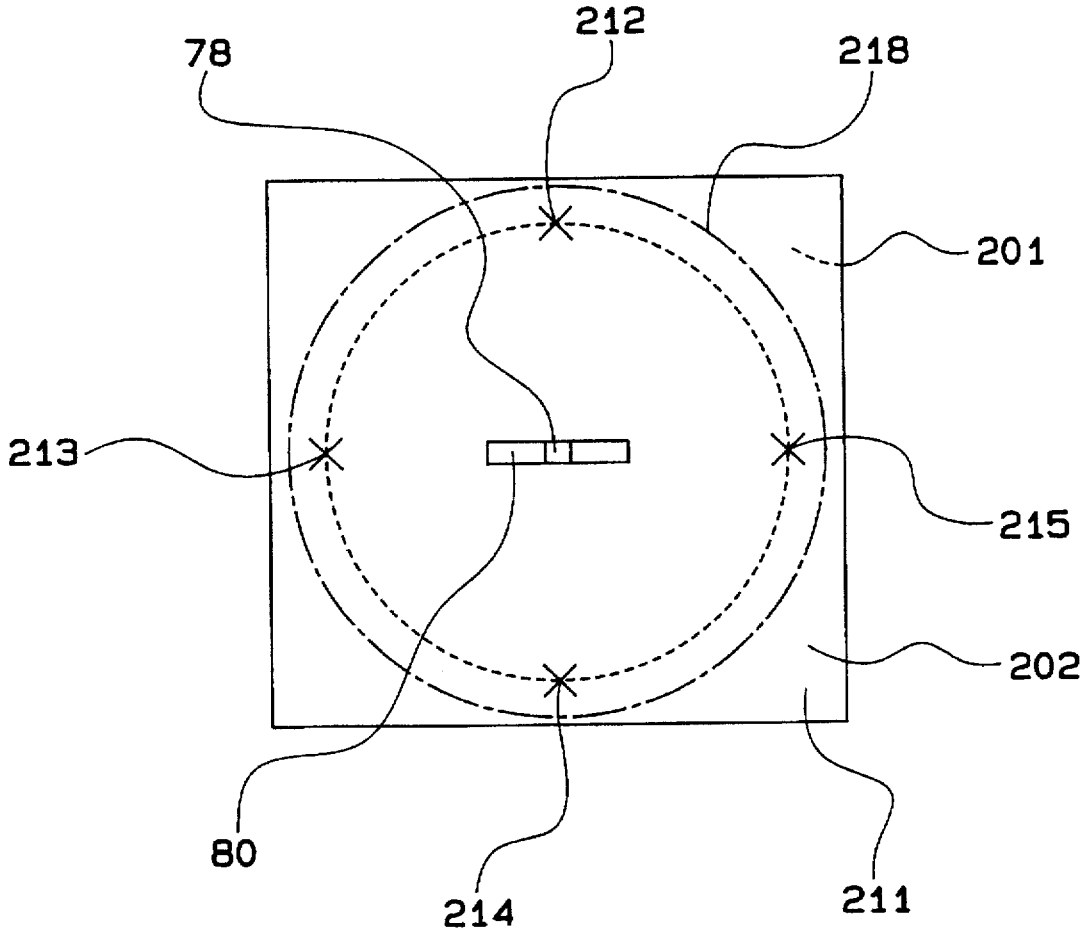
FIG. 45 is a section taken along line XXXXV—XXXXV of FIG. 44.

Specifically, as shown in FIGS. 43 to 45, the first and second orifice plates 201 and 202 are superposed with their first and second orifices 78 and 80 being perpendicular to each other, and the superposed second orifice plate 202 is welded from its lower face 211 at the plurality of points, e.g., four points in this case. These welded points are indicated at numerals 212, 213, 214 and 215 in FIG. 45.

These welded points are located in the circumference of such a circle as has its center at that of the orifice plates 201 and 202. This circle is located outside of the outermost positions of the first and second orifices 78 and 80. After these point-welding operations, the first and second orifice plates 201 and 202 are positioned on the valve body 26 by means of a jig and are welded along their circumferences, as indicated by single-dotted line in FIG. 45, to the valve body 26 from their lower face 211 by the laser beam. This whole circumference welded portion is indicated at numeral 218 in FIG. 45 to form a larger circle than that defined by the welded points 212, 213, 214 and 215. This is because it is intended to suppress the size changes of the first and second orifices 78 and 80 by the welded points 212, 213, 214 and 215. As a result, there is achieved an effect that the flow rate of the fuel to pass through the first and second orifices 78 and 80 is stabilized at the fuel injection time after the orifice plates have been assembled.

The aforementioned fixing methods of the twelfth and thirteenth embodiments can be combined with the foregoing first to eleventh embodiments.

Incidentally, throughout all the embodiments, both the first and second orifices are converged downstream, both of them may be made straight or diverged. Moreover, these three kinds of shapes can be combined in any manner.

What is claimed is:

1. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit-shaped hole for passing a fluid therethrough and a second plate superposed on the downstream side of said first plate and having a second hole communicating with a portion of said first hole, wherein said first plate and said second plate each have a characterizing portion at portions other than said first hole or said second hole for determining the relative positions of said first hole and said second hole, said first plate and said second plate being positioned relative to each other by putting said characterizing portions of said first plate and said second plate together.

2. A fluid injection nozzle according to claim 1, wherein said characterizing portion includes a first notch formed in the outer circumferential edge of said first plate, and a second notch formed in the outer circumferential edge of said second plate.

3. A fluid injection nozzle according to claim 1, wherein said characterizing portion includes a first positioning hole formed in said first plate, and a second positioning hole formed in said second plate.

4. A fluid injection nozzle according to claim 1, wherein at least one of said first hole and said second hole is converged downstream.

5. A fuel injection valve having a fluid injection nozzle according to claim 1, further comprising:

an injection valve body contacting with said needle;

a welding portion welding said first plate and said injection valve body; and a welding portion welding said first plate and said second plate.

6. A fuel injection valve having a fluid injection nozzle according claim 1, further comprising:

an injection valve body contacting with said needle;

a welding portion extending from said second plate to said first plate and fixing said first and second plates to said injection valve body.

7. A fuel injection valve having a fluid injection nozzle according to claim 1, further comprising:

an injection valve body contacting with said needle;

a whole circumference welding portion welding said first plate and said second plate; and a welding portion extending from said second plate to said first plate and fixing said first and second plates to said injection valve body.

8. A fuel injection valve having a fluid injection nozzle according to any of the claim 1, further comprising:

an injection valve body contacting with said needle;

a plurality of point-welding portions welding said first plate and said second plate; and a welding portion extending from said second plate to said first plate and fixing said first and second plates to said injection valve body.

9. A fluid injection nozzle according to claim 1 further comprising:

an injection valve body having an injection port in its leading end face, and a recess formed around said injection port for fitting said first plate and said second plate.

10. A fluid injection nozzle according to claim 9, wherein said recess has a depth no smaller than the sum of the thicknesses of said first plate and said second plate.

11. A fluid injection nozzle according to claim 1, wherein said first plate and said second plate are temporarily fixed by a plurality of welding points.

12. A fluid injection nozzle according to claim 11, wherein the portions of said welding points form part of a circumference around the center point of said first plate and said second plate and radially outside of said first hole and said second hole.

13. A fuel injection valve having a fluid injection nozzle according to claim 11, wherein said fluid injection nozzle is fixed along its whole circumference of such a circle on said injection valve body as is larger than the circle containing said welding points.

* * * * *